US007349645B2

(12) United States Patent
Ohnishi et al.

(10) Patent No.: US 7,349,645 B2
(45) Date of Patent: Mar. 25, 2008

(54) IMAGE FORMING APPARATUS WITH TRAYS THAT ARE MOVABLE TO A RECORDING SHEET DISCHARGE POSITION AND A CONTROLLER FOR CONTROLLING MOVEMENT OF THE TRAYS

(75) Inventors: Kenichi Ohnishi, Osaka (JP); Yumiko Tanaka, Osaka (JP)

(73) Assignee: Kyocera Mita Corporation (JP)

( * ) Notice: Subject to any disclaimer, the term of this patent is extended or adjusted under 35 U.S.C. 154(b) by 326 days.

(21) Appl. No.: 11/177,121

(22) Filed: Jul. 8, 2005

(65) Prior Publication Data

US 2007/0009278 A1 Jan. 11, 2007

(51) Int. Cl.
*G03G 15/00* (2006.01)

(52) U.S. Cl. ..... 399/82; 399/405

(58) Field of Classification Search ..... 399/75, 399/82, 361, 381, 397, 405
See application file for complete search history.

(56) References Cited

U.S. PATENT DOCUMENTS 5,237,382 A * 8/1993 Matsumura ..... 399/363
6,824,128 B2 * 11/2004 Nagata et al. ..... 270/58.08

FOREIGN PATENT DOCUMENTS

JP 10-291724 11/1998

* cited by examiner

*Primary Examiner*—Hoan Tran
(74) *Attorney, Agent, or Firm*—Gerald E. Hespos; Anthony J. Casell

(57) ABSTRACT

A machine (1) has an image former (200) for forming an image on a recording sheet. Movable trays are provided for receiving the recording sheets. A job manager (104) stores information concerning the tray for receiving the recording sheet, and a moving mechanism (605) moves the tray to a recording sheet discharge position according to information stored the job manager (104). An input device (11) allows an operator to input a copy value corresponding to the number of copies of the recording sheets to be discharged in an image forming job, and a tray moving controller (106) for controlling the moving mechanism (605) to move the tray if the copy value inputted from the input device (11) is higher than a predetermined copy value and to keep the tray from moving if the copy value is equal to or lower than the predetermined copy value.

20 Claims, 10 Drawing Sheets

IMAGE FORMING APPARATUS WITH TRAYS THAT ARE MOVABLE TO A RECORDING SHEET DISCHARGE POSITION AND A CONTROLLER FOR CONTROLLING MOVEMENT OF THE TRAYS

BACKGROUND OF THE INVENTION

1. Field of the Invention

The present invention relates to an image forming apparatus comprising a plurality of trays on which recording sheets are discharged and are movable to discharge a recording sheet to a desired tray.

2. Description of the Related Art

In conventional image forming apparatuses, such as copiers, printers, and composite machines capable of implementing these functions, it is known to provide a plurality of trays on which recording sheets are discharged. There are two groups of trays, the first group including a non-sorting tray for receiving non-sorted recording sheets, and the second group including a plurality of sorting trays for receiving sorted recording sheets. In the usual image forming job (copy job, print job), the recording sheet is discharged to the non-sorting tray. On the other hand, in the image-forming job including sorting, recording sheets are discharged to designated sorting trays, for example, in a print job, a recording sheet is discharged to a corresponding tray among the sorting trays according to a personal computer (PC) as an output source or to an identification of a user who has logged in the PC in a print job.

In the image forming apparatuses provided with trays as described above, there are two types, one being an apparatus in which a recording sheet is discharged to an intended tray by moving the trays to thereby place the intended tray at a recording sheet discharge position of the image forming apparatus main body, the other being an apparatus in which a recording sheet is discharged to an intended tray not by moving the tray but by providing a recording sheet conveyor path extending from the recording sheet discharge position of the image forming apparatus main body to each tray. Japanese Unexamined Patent Publication No. Hei 10-291724 discloses a recording sheet discharge mechanism of the former type.

However, in the image forming apparatus having movable trays, users are liable to dislike to use the movable trays because a longer time is required to move an intended tray to a recording sheet discharge position.

SUMMARY OF THE INVENTION

It is an object of the present invention to provide an image forming apparatus which is free from the problems residing in the prior art.

It is another object of the present invention to provide an image forming apparatus which has an improved movement of discharge trays to provide user with a higher degree of convenience.

According to an aspect of the present invention, an image forming apparatus is provided with an image former for forming an image on the recording sheet, a plurality of trays on which a recording sheet bearing an image formed thereon by the image former is discharged, a selector for selecting a tray for receiving the recording sheet bearing the image, a moving device for moving the tray selected by the selector to a recording sheet discharge position of an apparatus main body. Further, the image forming apparatus is provided with a copy or sheet value setter, and a controller for controlling the moving device to keep the tray from moving if the set copy or sheet value is equal to or lower than a predetermined value.

These and other objects, features, aspects, and advantages of the present invention will become more apparent from the following detailed description of the preferred embodiments/examples with reference to the accompanying drawings.

DETAILED DESCRIPTION OF THE PREFERRED EMBODIMENTS

Figure 1:
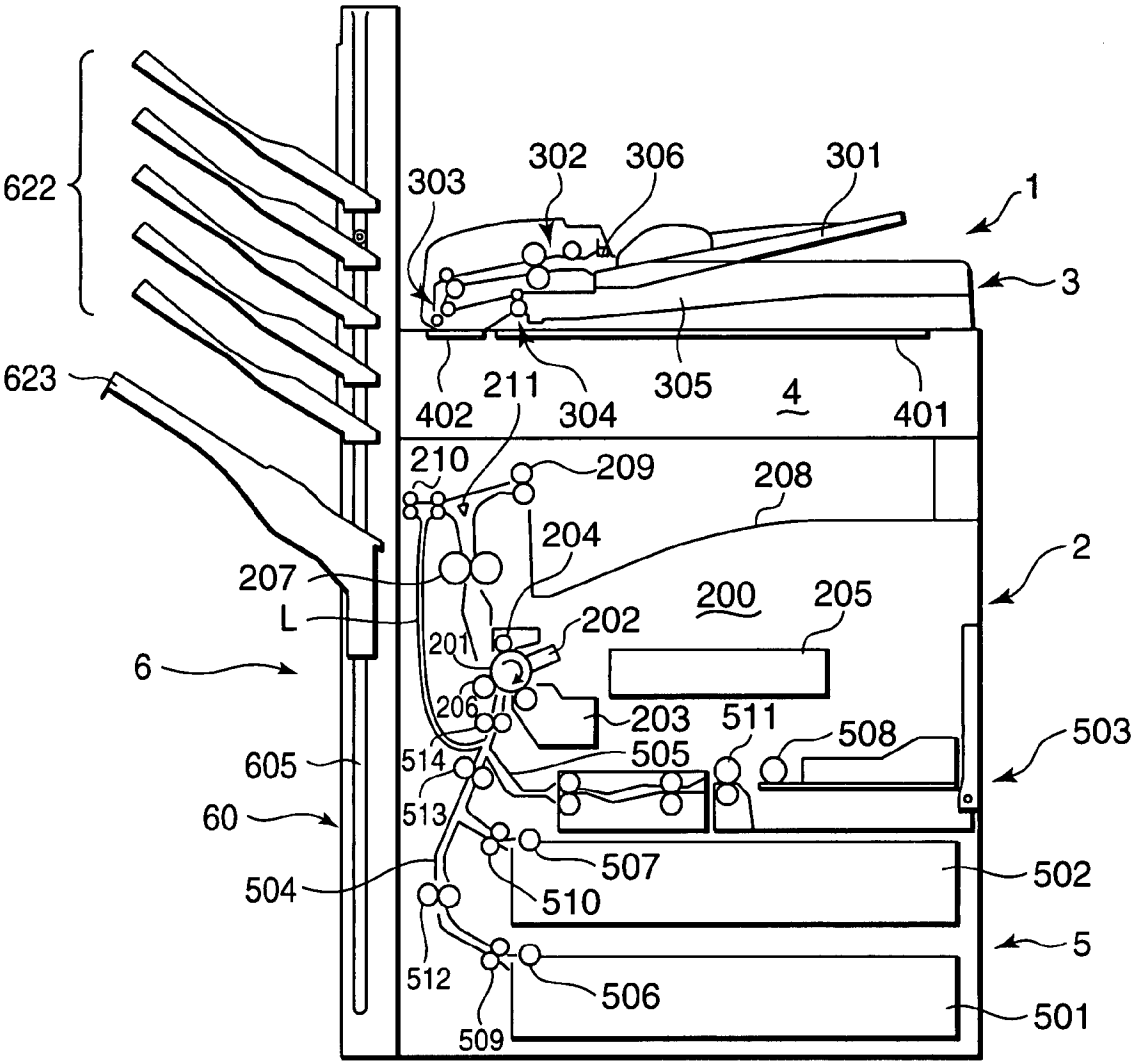
FIG. 1 is a side schematic diagram showing a functional configuration of a composite machine according to a first embodiment of the invention.

An image forming apparatus according to a first embodiment of the invention is hereinafter described with reference to the drawings. FIG. 1 is a side view schematically showing an internal configuration of a composite machine representing an exemplary image forming apparatus according to the first embodiment. The composite machine 1 implements functions such as copier, printer, scanner and facsimile, etc. The composite machine 1 has a main unit 2 which houses an image forming unit 200, an original document conveyor mechanism 3 also functioning as a copyholder and an original document reading unit 4 which are arranged on an upper side of the main unit 2, a sheet supply unit 5 arranged at a lower side of the main unit 2, and a tray unit 6 provided at a side periphery of the main unit 2.

The original document conveyor mechanism 3 is provided with an original document depositing unit 301, a feed-in drive unit 302 including a pair of conveyor rollers, a pair of conveyor rollers 303, a pair of discharge rollers 304, a discharge sheet board 305 and an original document detecting switch 306 for detecting the presence of an original document, and is adapted to convey an original document deposited on the original document depositing unit 301 by causing each page of the original document to automatically contact a contact glass 402 one by one and discharge the original document after scanning to the discharge sheet board 305.

The original document reading unit 4 comprises a scanner unit (not illustrated) which scans the original document image and generates image data from the resulted optical data, and is equipped with a contact glass 401 and a contact glass 402 on a top surface thereof. The scanner unit of the original document reading unit 4 reads the original document placed on the contact glass 401 or the image data obtained from the original document conveyed by the original document conveyor mechanism 3 by causing the original document to contact the contact glass 402 and then outputs the read data to an image memory unit 12 (refer to FIG. 2).

The sheet supply unit 5 comprises sheet supply cassettes 501, 502 storing various types of sheets according to sizes and horizontal and vertical orientation and a manual sheet supply unit 503. Furthermore, the sheet supply unit 5 also comprises a conveyor path 504 for conveying the sheets from the sheet supply cassettes 501, 502 to the image forming unit 200 and a conveyor path 505 for conveying the sheets from the manual sheet supply unit 503 to the image forming unit 200. The sheet supply cassettes 501, 502 and the manual sheet supply cassette 503 are equipped with pick-up rollers 506, 507, 508 for picking up the stored sheets (recording sheets) and a pair of sheet supply rollers 509, 510, 511 for sending the sheets to the conveyor path one by one.

The conveyor path 504 is provided with a pair of conveyor rollers 512, 513 for conveying the sheets and a pair of resist rollers 514 which hold the sent sheets in a predetermined location before the image forming unit 200. The conveyor path 505 merges with the conveyor path 504 upstream of the pair of resist rollers 514.

The image forming unit 200 has a photosensitive drum 201 which is pivotally attached thereto, a charge unit 202 fixed at the periphery of the photosensitive drum 201, a developer 203, a cleaning unit 204, a laser scanning unit 205, a transfer roller 206 and a pair of fixing rollers 207. The charge unit 202 charges uniformly a surface of the photosensitive drum 201 to a predetermined electric potential. The laser scanning unit 205 sends a laser beam to a surface of the photosensitive drum 201 in accordance with the image data sent from the controller 10 (see FIG. 2) to form an electrostatic latent image on the surface of the photosensitive drum 201.

The developer 203 fixes the toner to the electrostatic latent image to expose the image, the transfer roller 206 prints the exposed toner image on the sheet and the pair of fixing rollers 207 fix the toner image printed on the sheet. The cleaning unit 204 cleans the residual toner remaining on the surface of the photosensitive drum 201 after image printing.

A sheet discharge unit 208 is provided on an upper side of the main unit 2 for receiving the sheets conveyed by the pair of fixing rollers 207 and discharged thereto by the pair of discharge rollers 209. The tray unit 6 receives the sheets conveyed by the pair of fixing rollers 207 and discharged thereto by the pair of discharge rollers 210. Hence, it is possible to switch the discharge direction of the sheets between the pair of discharge rollers 209 and the pair of discharge rollers 210 using a discharge branch guide 211 driven in accordance with a control signal sent from the controller 10.

In case of forming an image on both sides of a recording sheet, first, an image is formed on one side of the recording sheet in the image forming unit 200 and then the recording sheet is nipped by the pair of discharge rollers 209. While still in this nipping state, the pair of the discharge rollers 209 are reversed to thereby switch back the recording sheet which is sent to the sheet conveyor path L and then is re-conveyed upstream of the image forming unit 200. Here, an image is formed on the other side of the recording sheet, after which, the recording sheet bearing images on both sides thereof is discharged to the sheet discharge unit 208 or is conveyed to the tray unit 6.

The tray unit 6 is provided with a plurality of sorting trays 622, one non-sorting tray 623 and a moving mechanism 605, and is adapted to guide the recording sheet fed-in by the pair of discharge rollers 210 of the main unit 2 onto the non-sorting tray 623 or a sorting tray(s) 622. In this embodiment, the recording sheet is discharged onto the non-sorting tray 623 when using the copier function, whereas when using the printer function, it is discharged onto any tray among the sorting trays which is designated by an operator requesting the printing operation. The designation of the sorting tray is determined according to an information processing device such as a personal computer (PC) of the print command source or/and according to an identification of the user who logged in on the personal computer, and the designated tray information is sent to the composite machine 1 as one of the print command data sent from the information processing device to the composite machine 1. The moving mechanism 605 moves the non-sorting tray 623 and the sorting trays 622 according to the control signal from the controller 10 such as to position the designated tray at the recording sheet discharge slot of the main unit (the position of the pair of discharge rollers 210). The non-sorting tray 623 and the sorting trays 622 are integrally moved.

Figure 2:
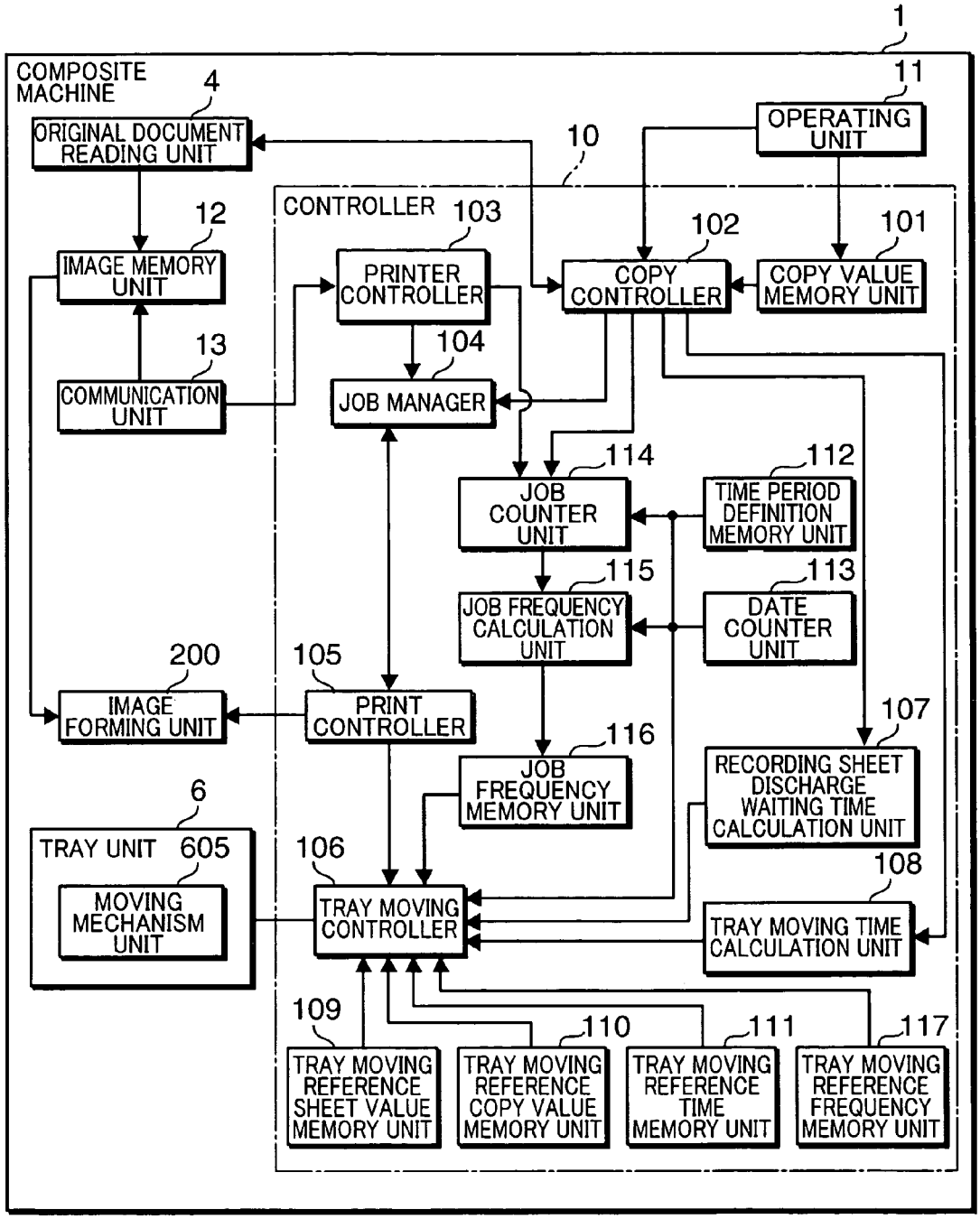
FIG. 2 is a block diagram showing a functional configuration of the composite machine.

FIG. 2 is a block diagram showing the functional configuration of the composite machine 1 according to this invention. Here, the functional configuration of the composite machine is limited in particular to copier and printer functions. The composite machine 1 is provided with an operating unit 11, an original document reading unit 4, an image memory unit 12, a communication unit 13, an image forming unit 200, a tray unit 6 and a controller 10. The operating unit 11 is adapted to allow a user to input a command to the composite machine 1 and thereby functions as a user interface of the composite machine 1. With respect to this invention, the operating unit 11 is configured to allow a user to input a number of copies (copy value) and a copy start command. As herein used, "copy value" shows the number of copies (sets of copies) made of the same target document, and "sheet value" shows the number of sheets to be discharged in an image forming job. The copy value is inputted using the numeric keypad provided on the operating unit. The copy start command is a command for initiating the copy operation and is inputted by pressing the start key provided on the operating unit.

The image memory unit 12 includes a random access memory (RAM) or the like for storing the image data read by the original document reading unit 4 and the image data received from the communication unit 13. The communication unit 13 is connected to a communications line such as a network and carries out communications between the composite machine 1 and other memory processing devices. The communication unit 13 of this embodiment is adapted to receive a print request (a request to use the printer function of the composite machine 1) sent to the composite machine 1 from a PC which is connected to the composite machine 1 via a network. When the communication unit 13 receives image data as a print request, it writes this image data to the image memory unit 12.

The controller 10 controls the entire composite machine 1 and comprises a CPU (central processing unit), a ROM (read-only memory) for storing programs which are executed by the CPU, a RAM (random access memory) used in the work area, etc. of programs executed by the CPU, etc. The controller 10 has a copy value memory unit 101, a copy controller 102, a printer controller 103, a job manager 104, a print controller 105, a tray moving controller 106, a recording sheet discharge waiting time calculation unit 107, a tray moving time calculation unit 108, a tray moving reference sheet value memory unit 109, a tray moving reference copy value memory unit 110, tray moving reference time memory unit 111, a time period definition memory unit 112, a date counter unit 113, a job counter unit 114, a job frequency calculation unit 115, a job frequency memory unit 116 and a tray moving reference frequency memory unit 117.

The copy value memory unit 101 stores a copy value written thereto by the operating unit 11 after a user has inputted such a value to the operating unit.

The copy controller 102 is adapted to control the copier function in the composite machine 1. After a copy start command is inputted to the operating unit 11, it sends the command to the copy controller 102 which, upon receiving it, sends an instruction to the original document reading unit 4 to read the original document. The original document reading unit 4 reads the original document in accordance with the read command and writes the image data to the image memory unit 12. The original document reading unit 4 also sends the address of the read image data (image data address) stored inside the image memory unit 12 and the number of pages of the read image(s) to the copy controller 102. After the copy controller 102 receives the image data address and the number of pages, it reads the copy value from the copy value memory unit 101 and sends to the job manager 104 information of a copy job input, the image data address, the number of pages, the copy value (output value) as (copy) job data. Substantially simultaneous with this, the copy controller 102 sends to the recording sheet discharge waiting time calculation unit 107 a command requesting calculation of the recording sheet discharge waiting time, the number of pages and the copy value. Also, at substantially the same time, the copy controller 102 sends a command to the tray moving time calculation unit 108 requesting calculation of the time needed to move the tray.

The printer controller 103 is adapted to control the printer function in the composite machine 1. The printer controller 103 receives from the communication unit 13 print job data with respect to a print request received from a PC, etc. connected to a communications line. The print job data includes at least the address of the read image data (image data address) stored in an image memory unit 12, the number of pages of the read image(s), the output value and the tray number of the sorting tray onto which the recording sheets are to be discharged. When the printer controller 103 receives the print job data, it sends to the job manager 104 information of a print job input, the image data address, the number of pages, the output value and the discharge tray number as a (print) job data. The discharge tray number with respect to the sorting trays 622 is considered to be 1 to 4 in a downward direction.

Figure 3:
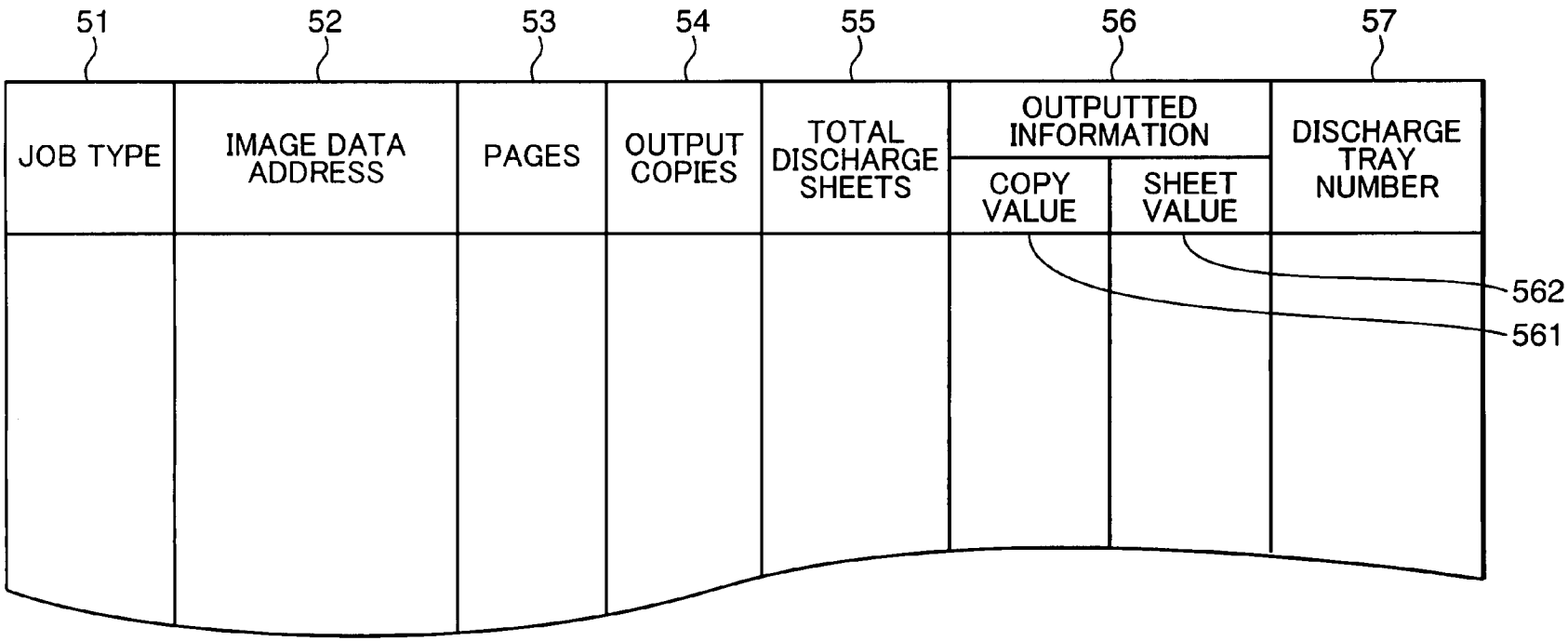
FIG. 3 is a diagram showing a configuration of a job management table.

The job manager 104 stores a job management table as shown in FIG. 3 and is configured such that upon receiving job data from the printer controller 103 and the copy controller 102, it writes the job data in a new line of the job management table. The job type column 51 of the job management table stores an identifier which identifies whether the job in the new line is a print job or a copy job. The image data address column 52 stores the start address of the image memory unit 12 which stores the image data of the job in the new line. The pages column 53 stores the number of all the pages of one set of images for the job in the line. The output copy value column 54 stores the number of output copies (copy value) of the same set of images for the job in the line. The total discharge sheet value column 55 stores the number of sheets of all recording sheets to be discharged with respect to the job in the line. The column titled copy value 561 of the outputted information column 56 stores the number of copies already discharged with respect to the job in the line whereas the column titled sheet value 562 in the same column 56 stores the number of sheets that have already been discharged of one copy made of the original document which is being discharged at that moment. Specifically, in case value [2] is inputted in the copy value column 561 of the outputted information column 56, and value [7] is inputted in the sheet value column 562 of the same column 56, it means that 2 copies made of the original document and 7 sheets of the third copy have already been discharged. The discharge tray number column 57 stores the number of the tray on which the recording sheets for the job in the line are to be discharged.

The job manager 104 updates the outputted information 56 in the first line of the job management table each time it receives information from the print controller 105 that one sheet of recording sheet has been discharged. In case the job manager 104 receives from the printer controller 103 information of a print job input, the image data address, the number of pages, the output value (i.e. copy value) and the discharge tray number, it creates a new line right after the existing line (or in case there is no existing line, it becomes the first line) in the job management table shown in FIG. 3 and further writes this print job data thereto. Specifically, the job type column 51 contains information regarding a print job input, the image data address column 52 contains the received image data address, the pages column 53 contains the received number of pages, the output copy value column 54 contains the received number of the copies to be outputted, the total discharge sheet value column 55 contains a value obtained by multiplying the number of pages of the pages column 53 and the output copy value of the output copy value column 54 which are written in the same line, the copy value column 561 and the sheet value column 562 of the outputted information column 56 include a default value [0] respectively, and the discharge tray number column 57 includes a received discharge tray number.

When the job manager 104 receives information of a copy job input, the image data address, the number of pages and the copy value from the copy controller 102, it creates a new first line in the job management table shown in FIG. 3 and then writes this copy job data thereto. Specifically, the job type column 51 contains information about a copy job input, the image data address column 52 contains a received image data address, the pages column 53 contains the received number of pages, the output copy value column 54 contains the received number of copies to be discharged, the total discharge sheet value column 55 contains a value obtained by multiplying the number of pages of the pages column 53 and the copy value of the output copy value column 54 which are written in the same line, the copy value column 561 and the sheet value column 562 of the output information column 56 include a default value [0] respectively. In case of a copy job, no value is written to the discharge tray number column 57 such that at this time copies are discharged onto the non-sorting tray 623. If when writing the copy job data to the job management table, data has already been written thereto (there is already a line), this copy job data is written in a first line whereas the already existing data line is shifted behind.

Referring back to FIG. 2, the print controller 105 is adapted to control a print operation (forming of an image on the recording sheet). The print controller 105 checks the job management table of the job manager 104 and if a job (line) is detected therein, it sends an instruction to the image forming unit 200 to form an image on the recording sheet and then discharge the recording sheet bearing the image. After receiving such instruction, the image forming unit 200 reads the image data from the image memory unit 12 and thereby forms the image in accordance with the data. After each printed page, the print controller 105 sends information that another page has been printed to the job manager 104, which updates the data in the copy value column 561 and the sheet value column 562 of the outputted information column 56 with respect to the job written in the first line of the job management table, in accordance with the received information. Also, if the job, which may be a print job or a copy job, is a print job, the print controller 105 receives a discharge tray number from the job manager 104 and sends it to the tray moving controller 106 to thereby instruct a movement of the tray.

The recording sheet discharge waiting time calculation unit 107 calculates the waiting time until the recording sheet discharge operation starts in accordance with an instruction received from the copy controller 102 to calculate the recording sheet discharge waiting time and then sends the calculated time to the tray moving controller 106. The recording sheet discharge waiting time calculation unit 107 determines the recording sheet discharge waiting time from a table held by the recording sheet discharge waiting time calculation unit 107 in advance showing the relationship between the output copy value, the number of pages, etc. and the recording sheet discharge waiting time in accordance with conditions such as number of pages and the output copy value of the image to be printed. If the recording sheet discharge waiting time can be determined by using a calculating formula, it may be determined by such calculation. During the time interval from reading of the original document till discharge of the recording sheet bearing an image formed thereon, the composite machine 1 carries out operations such as image processing for improving and adjusting the display of the image and/or two-in-one processing (function for synthesizing the image such that two pages are displayed in only one page) such that, the larger the number of pages, the longer the waiting time until start of the recording sheet discharge.

The tray moving time calculation unit 108 calculates the time (tray moving time) needed to move the non-sorting tray to the recording sheet discharge slot in accordance to an instruction received from the copy control unit 102 to calculate the tray moving time, it and then sends the calculated time to the tray moving controller 106. The tray moving time calculation unit 108 determines the tray moving time from a table held by the tray moving time calculation unit 108 in advance showing the relationship between the present position of the non-sorting tray and the tray moving time in accordance with the position of the non-sorting tray before the moving operation.

The tray moving reference sheet value memory unit 109 stores a predetermined reference value (maximum value), for instance [10] of the total number of sheets of the recording sheets to be discharged in a copy job for the case that the recording sheet is discharged without moving the non-sorting tray until all recording sheets have been discharged. The sheet value may be set by the user by use of the operating unit 11.

The tray moving reference copy value memory unit 110 stores a predetermined reference value (maximum value), for instance [5] of the total number of copies of the recording sheets to be discharged in a copy job, as the tray moving first reference copy value for the case that the recording sheets are discharged without moving the non-sorting tray until all recording sheets have been discharged. If the discharge tray for the present job (present image forming job) and a discharge tray for the job following the next job (waiting image forming job) are the same, the tray moving reference copy value memory unit 110 stores a predetermined reference value (minimum value) for instance [10] of the total number of sheets of the recording sheets to be discharged, as the tray moving second reference copy value for the case when the recording sheets are discharged by moving the non-sorting tray with respect to the next copy job (next image forming job). The copy value may be set by the user by use of the operating unit 11.

If the discharge tray for the present job and the discharge tray for the job following the next job are the same, the tray moving reference time memory unit 111 stores a predetermined reference value (maximum value) for instance [5] (seconds) of the moving time for the non-sorting tray, as a tray moving reference time, having as reference the fact whether the recording sheet is discharged without moving the non-sorting tray with respect to the next copy job. The copy value may be set by the user by use of the operating unit 11.

The time period definition memory unit 112 stores the definition for the method of defining a (predetermined) range of time (time period) determining the frequency of an image forming job (job frequency) in the composite machine 1. This time period can be for instance every day before noon, afternoon, etc. (for instance Monday before noon, etc.). This definition may be set by the user by use of the operating unit 11.

The date counter unit 113 is adapted to measure the time (including days of the week).

The job counter unit 114 receives information from the copy controller 102 or the printer controller 103 that a job has been inputted and thereby counts the number of jobs (specifically, the number of jobs generated on Monday before noon) inputted during the time period defined in the time period definition memory unit 112.

The job frequency calculation unit 115 calculates the job frequency in the time period defined in the time period definition memory unit 112. The job frequency calculation unit 115 divides the number of jobs counted by the job counter unit 114 in the time period defined in the time period definition memory unit 112 by the time (length) of that time period to thereby determine the number of jobs per unit time (for instance one hour) which is considered the job frequency. The job frequency may be calculated considering the past job frequencies for the same period of time which are stored in the job frequency memory unit 116 to be described hereinafter (for instance, calculate the average between the past job frequency and the job frequency calculated at present).

The job frequency memory unit 116 stores the job frequency calculated by the job frequency calculation unit 115.

The tray moving reference frequency memory unit 117 stores a reference value (tray moving reference frequency) for determining whether to move a desired tray to the recording sheet discharge slot according to the job frequency. The tray moving reference frequency may be set by the user by the use of the operating unit 11.

The tray moving controller 106 controls the moving operation of the trays in the tray unit 6. The tray moving controller 106 controls the moving mechanism unit 605 in accordance with the discharge tray number designated with respect to the print job which is received from the job manager 104 such that the recording sheet is always discharged onto the designated sorting tray. The tray moving controller 106 controls the moving operation of the tray(s) with respect to a copy job as hereinafter described. If the total number of copies of the recording sheets to be discharged in the copy job is equal to or lower than the tray moving first reference copy value, and if the total number of sheets to be discharged is equal to or lower than a tray moving reference sheet value, the tray(s) is not moved until all the recording sheet in the copy job have been discharged. Irrespective of this, if the trays are moved until the discharge of the recording sheets is initiated, the non-sorting tray is moved to the recording sheet discharge slot. However, irrespective of this, if the discharge tray for the job following the copy job and the tray placed at the recording sheet discharge slot before start of the copy job are the same (the print job in execution is not interrupted by the copy job), the tray is not moved. In such a case, if the tray moving time with respect to the copy job is within a tray moving reference time period and if the total number of copies of the recording sheets to be discharged in the copy job is equal to or above a tray moving second reference copy value, the non-sorting tray is moved to the recording sheet discharge slot. Also, when a plurality of copies are discharged, the tray is moved if the time interval between respective discharges of the copies is long enough to enable such moving operation. Also, if the job frequency during a present time period which is stored in the job frequency memory unit 116 is higher than the tray moving reference frequency stored in the tray moving reference frequency memory unit 117, the tray moving controller 106 always moves the non-sorting tray to the recording sheet discharge slot, whereas if the job frequency is lower than the tray moving reference frequency, the tray is moved according to the above control operation.

In order to execute the tray moving operation with respect to the copy job, the tray moving controller 106 determines whether or not to move the non-sorting tray to the recording sheet discharge slot according to an instruction regarding the positioning of the non-sorting tray received from the print controller 105, the recording sheet discharge waiting time calculated by the recording sheet discharge waiting time calculation unit 107, the tray moving time calculated by the tray moving time calculation unit 108, the tray moving reference sheet value stored in the tray moving reference sheet value memory unit 109, the tray moving first reference copy value and the tray moving second reference copy value stored in the tray moving reference copy value memory unit 110, and the tray moving reference time stored in the tray moving reference time memory unit 111. Further description with respect to this control operation is given hereinafter while referring to the partial flow chart shown in FIG. 4.

Figure 4:
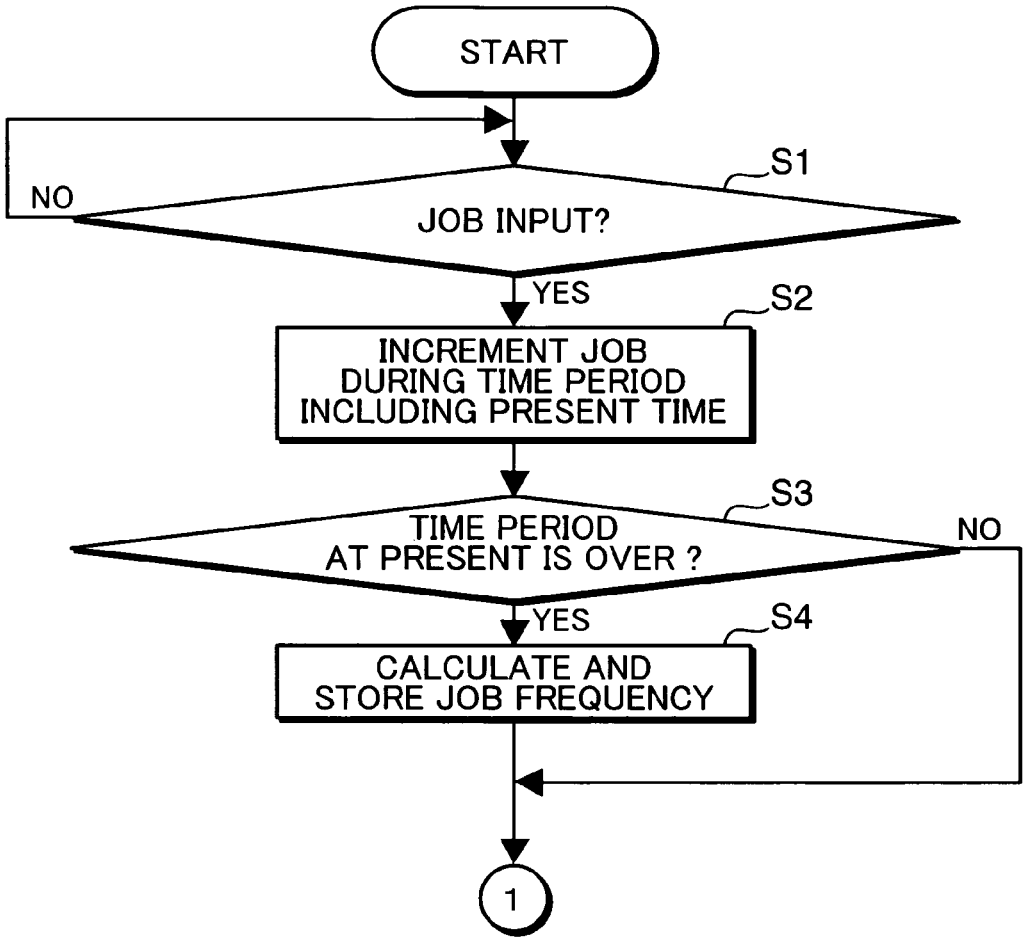
FIG. 4 is a part of a flow chart for a tray moving control operation during a copy job executed by the composite machine.
Figure 5:
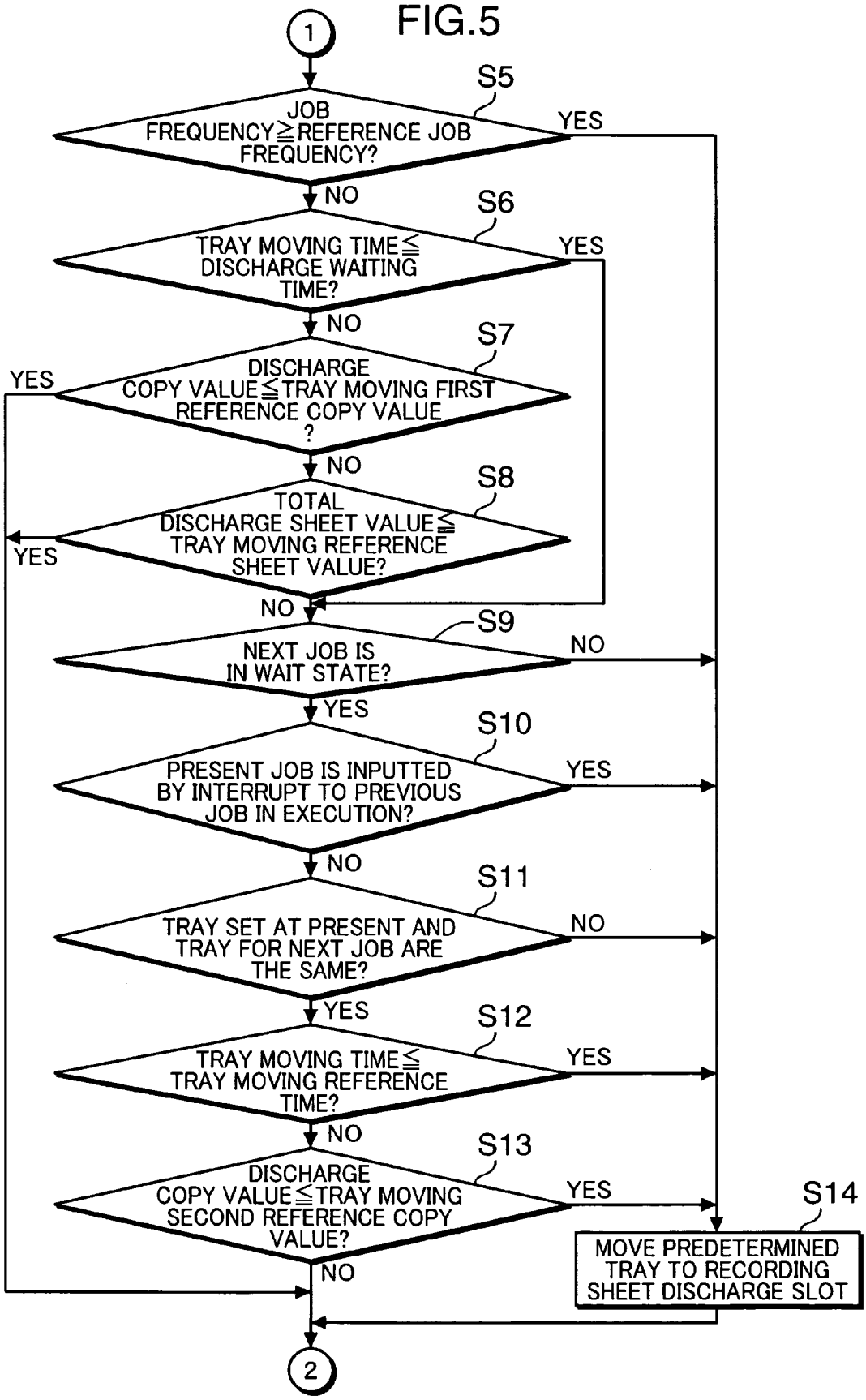
FIG. 5 is another part of the flow chart for the tray moving control operation.
Figure 6:
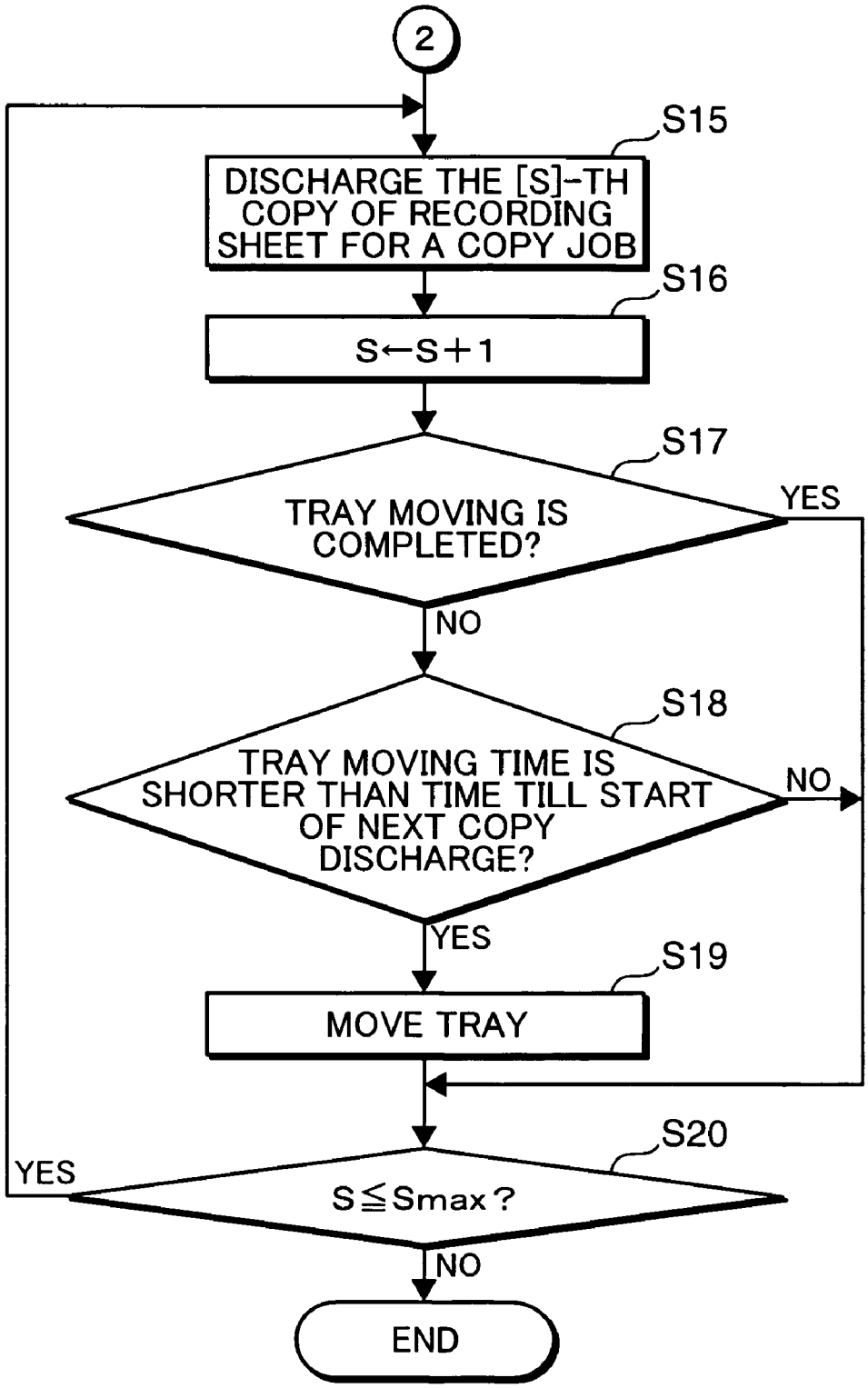
FIG. 6 is another part of the flow chart for the tray moving control operation.

FIG. 4, FIG. 5 and FIG. 6 are partial flow charts showing a flow of a tray moving control operation carried out with respect to a copy job executed in the composite machine 1 of this embodiment. The default value of the number of copies [S] (S-th copy) to be printed is set to [1]. Steps from S2 to S4 represent operations for calculating the job frequency defined by a time period including the present moment (present time). Here, the job frequency is calculated for the purpose of tray moving control with respect to any jobs to be carried out in the future (not the job described in the flow chart). Steps from S5 to S13 describe operations for determining whether the tray should be moved or not. If the tray is moved, Step S14 is carried out before moving to Step S15, whereas if the tray is not moved, Step S14 is skipped and operation moves to Step S15. Steps from S15 to S20 describe tray moving control operations during discharge of the recording sheets.

In Step S1, the operating unit 11 checks whether or not the start key on the operating unit 11 has been pressed (NO in Step S1), and when the start key is pressed (YES in Step S1), it sends information to the copy controller 102 that a copy job has been inputted thereto. At this time, if an input of a copy value is inputted to the operating unit 11 with respect to a copy job, the copy value [Smax] is written to the copy value memory unit 101. The copy controller 102 receives information that a copy job has been inputted and then sends an instruction to the original document reading unit 4 to read the image of the original document subjected to the copy operation. The original document reading unit 4 reads the image of the original document to be copied in accordance with the received instruction and then writes the image data of the read image to the image memory unit 12. Then, the original document reading unit 4 sends the address of the image data written to the image memory unit 12 and the number of pages of the original document to the copy controller 102. The copy controller 102 reads the copy value from the copy value memory unit 101 and then sends the image data storage address, the number of pages and the number of copies to be made of the original document, etc. to the job manager 104 as data for the copy job (job data). The job manager 104 adds this (copy) job data at the head of the job management table (first line).

In Step S2, the copy controller 102 sends information to the job counter unit 114 that a job has been inputted thereto. Upon receiving such information, the job counter unit 114 reads the present time from the date counter unit 113, checks the time period definition memory unit 112 to obtain a time period definition including the present time and thereby increments the job counter (held by the job counter unit 114) with respect to that time period. If the first job is inputted after entering the present period of time, value [1] is set in the job counter. The job counter of the job counter unit 114 also counts incidence of print jobs. In Step S3, the job counter unit 114 checks the data counter unit 113 and the time period definition memory unit 112 and if it detects that the period of time for counting the jobs has ended (YES in Step S3), the flow of operations moves to Step S4. In Step S4, the job counter unit 114 sends the job counter value to the job frequency calculation unit 115 which then checks the time period definition memory unit 112 and the date counter unit 113 to obtain a time period definition with respect to the received counter value and thereby calculates the frequency of jobs inputted during that time period. Here, the number of jobs per unit time may be calculated by dividing the job counter value received from the job counter by the length of the time period (for instance, 5 hours). The job frequency calculation unit 115 writes the calculated job frequency together with the time period definition to the job frequency memory unit 116.

In the branch of Step S3, the flow of operations moves to Step S5 if the time period for counting the jobs is not completed (NO in Step S3) and the operation of Step S4 is completed. In Step S5, the tray moving controller 106 checks the time period definition memory unit 112 and the date counter unit 113 to obtain a time period definition including the present time and then reads the job frequency during that time period from the job frequency memory unit 116. Also, the tray moving controller 106 receives the tray moving reference frequency from the tray moving reference frequency memory unit 117 and compares it to the job frequency. If the job frequency is lower than the tray moving reference frequency (NO in Step S5), the flow continues to Step S6.

In Step S6, the copy controller 102 sends an instruction to the recording sheet discharge waiting time calculation unit 107 to calculate the time necessary until start of recording sheet discharge in a copy job. The recording sheet discharge waiting time calculation unit 107 calculates the time until start of the recording sheet discharge operation in accordance with the received instruction and then sends the result to the tray moving controller 106. The copy controller 102 also sends an instruction to the tray moving time calculation unit 108 to calculate the time needed in order to move the non-sorting tray 623 to the recording sheet discharge slot. The tray moving time calculation unit 108 calculates the tray moving time in accordance with the received instruction and then sends the result to the tray moving controller 106. The tray moving controller 106 compares both time values and if the discharge waiting time is shorter than the tray moving time (NO in Step S6), the flow continues to Step S7.

In Step S7, the tray moving controller 106 receives a discharge copy value for the job from the job manager 104 and at the same time reads the tray moving first reference copy value from the tray moving reference copy value memory unit 110, then it compares these two values. As a result of the comparison, if the discharge copy value is higher than the tray moving first reference copy value (NO in Step S7), the flow continues to Step S8. In Step S8, the tray moving controller 106 receives the total sheet value and the discharge copy value for the job from the job manager 104 and thereby calculates the total discharge sheet value while at the same time it reads the tray moving reference sheet value from the tray moving reference sheet value memory unit 109, after which it compares these two values. If the total discharge sheet value is higher than the tray moving reference sheet value (NO in Step S8), and the tray moving time is equal to or shorter than the discharge waiting time in the branch of Step S6 (YES in Step S6), the flow continues to Step S9.

In Step S9, the tray moving controller 106 checks the job manager 104 to determine whether there is a next job in a wait state (whether there are two or more lines in the job management table), and if it is in a wait state (YES in Step S9), the flow continues to Step S10. In Step S10, the tray moving controller 106 checks the job manager 104 to determine whether the copy job has been inputted by an interrupt to the print job in execution at present (whether the outputted sheet value or the outputted copy value of the job at the second line in the job management table is [0] or not), and if it determines it has not been inputted by an interrupt (NO in Step S10), the flow moves to Step S11. In Step S11, the tray moving controller 106 receives the discharge tray number for the next job (the discharge tray number for the second line in the job management table) from the job manager 104, checks if this discharge tray number and the discharge tray presently located at the recording sheet discharge slot are the same, and if they are (YES in Step S11), the flows continues to Step S12.

In Step S12, the tray moving controller 106 reads the tray moving reference time from the tray moving reference time memory unit 111 and then compares this reference time with the tray moving time calculated in Step S6. If the comparison reveals that the tray moving time is equal to or less than the tray moving reference time (NO in Step S12), the flow moves to Step S13. In Step S13, the tray moving controller 106 reads the tray moving second reference copy value from the tray moving reference copy value memory unit 110 and compares this copy value with the discharge copy value calculated in Step S7.

If the copy value is equal to or higher than a tray moving second reference copy value (YES in Step S13), the job frequency is equal to or higher than a tray moving reference frequency (YES in Step S5) in the branch of Step S5, the next job is not in a wait state (NO in Step S9) in branch of Step S9, the job has been inputted by an interrupt operation (YES in Step S10) in branch of Step S10, the tray set at the present and the tray for the next job are not the same (NO in Step S11) in branch of Step S11 and the tray moving time is equal or shorter than a tray moving reference time (YES in Step S12) in the branch of Step S12, then the flow moves to Step 14.

In Step S14, the print controller 105 sends an instruction to the tray moving controller 106 to move the tray. The tray moving controller 106 receives the discharge tray number for the job from the job manager 104 and sends an instruction to the moving mechanism unit 605 to move the tray having that the designated tray number to the recording sheet discharge slot. The moving mechanism unit 605 moves the tray to the recording sheet discharge slot in accordance with the received instruction. If the discharge copy value is equal to or lower than the tray moving first reference copy value (YES in Step S7) in the branch of Step S7, the total sheet value is equal to or lower than a tray moving reference sheet value (YES in Step S8) in branch of Step S8, the discharge copy value is lower than the tray moving second reference copy value (NO in Step S13) in the branch of Step S13, and the operation of Step S14 is completed, the flow continues to Step S15.

In Step S15, the print controller 105 sends an instruction to the image forming unit 200 to form an image on the recording sheet for each one page of the original document. The image forming unit 200 forms an image on the recording sheet with respect to each page of the original document in accordance with the received instruction, after which it discharges the recording sheet bearing the image from the recording sheet discharge slot. After the recording sheets corresponding to one copy are printed, the operation of Step S16 is initiated whereby the job manager 104 increments the discharge copy value of the job management table. In Step S17, the tray moving controller 106 checks whether the tray moving operation is completed, and in case it is not completed (NO in Step S17), the flow continues to Step S18. In Step S18, the tray moving controller 106 compares the tray moving time received from the tray moving time calculation unit 108 with the time until the start of the next copy discharge and if the tray moving time is shorter than the other time value (YES in Step S18), the operation of Step S19 is initiated. The time until start of the next copy discharge is a time in accordance with the printing settings such as one-side printing or two-side printing (particularly, not necessarily the discharge interval between each copy, but also the discharge interval between each page) stored in advance in the tray moving controller 106. In Step S19, the tray moving controller 106 causes the moving mechanism unit 605 to move the non-sorting tray to the recording sheet discharge slot. If the tray moving operation is completed (YES in Step S17) in the branch of Step S17, the tray moving time is longer than the other time value (NO in Step S18) in the branch of Step S18 and the operation of Step S19 is completed, the flow continues to Step S20. In Step S20, the print controller 105 checks whether the copy value corresponding to the number of copies to be printed [S] is equal to or lower than the copy value [Smax], and if [S] is equal to or lower than [Smax] (YES in Step S20), the routine returns to Step S15 in which the next copy is printed. If [S] is higher than [Smax] (NO in Step S20), the printing operation is completed.

In the composite machine 1 according to this embodiment, the recording sheets are generally discharged to the tray already positioned at the recording sheet discharge slot at the time the job starts if the copy value of the recording sheets to be discharged in the job is equal or lower than a copy value set in advance (tray moving first reference copy value), or to a desired tray if the copy value is higher than the copy value set in advance. Also, if the total sheet value of the recording sheets to be discharged in the job is equal or lower than a sheet value set in advance (tray moving reference sheet value), the recording sheets are discharged onto the tray already positioned at the recording sheet discharge slot at the time the job starts. Accordingly, it is possible to prevent moving of the tray in case of a relatively small number of sheets of recording sheets are discharged which is equal to or lower than a predetermined copy value and sheet value, such that a situation where the tray moving time is too long as compared to the overall discharge time required for discharging the recording sheets can be avoided. Specifically, in case the copy value and the sheet value of the copies to be discharged is small, the recording sheet is discharged to the tray that has been used till then thus avoiding wasting time to move the tray and consequently enabling reduction of the time required until the recording sheet discharge operation is completed.

Still, if the desired tray can be moved to the recording sheet discharge slot until the recording sheet discharge operation starts, irrespective of the above, the recording sheets are discharged to the desired tray. Consequently, if there is sufficient time to move the desired tray to the recording sheet discharge slot, the recording sheets can be discharged to the desired tray.

However, irrespective of the above described, if the tray designated for the job which is in a wait state following the job is the same as the tray already positioned at the recording sheet discharge slot at the time the job starts, all the recording sheets are discharged to this tray. Even in such a case, if the tray moving time with respect to the job is within a predetermined time (tray moving reference time) and if the total discharge copy value of the recording sheets for the job is equal to or higher than a second copy value set in advance (tray moving second reference copy value), the recording sheets are discharged to the desired tray. Also, if a plurality of copies are discharged, the tray is moved in case there is sufficient time to carry out such operation during the time interval between respective discharges of the copies.

If the time period when the job is inputted is a time period with a high job frequency, the recording sheets are necessarily discharged to the desired tray such that it is possible to avoid discharge of recording sheets for a plurality of jobs to the same tray during a time period with a large number of printing jobs.

Next, a second embodiment of the invention is described with reference to the drawings. With respect to the first embodiment, the composite machine is configured such that if the job frequency during a time period when jobs are inputted is equal to or higher than a predetermined frequency (tray moving reference frequency), the recording sheets are always discharged to the desired tray. However, the composite machine according to the second embodiment is configured such that in case the job frequency is even higher, even smaller values are set for the tray moving first reference copy value and the tray moving reference sheet value.

In this embodiment, the job moving reference frequency memory unit 117 stores a tray moving first reference frequency and a tray moving second reference frequency which is higher than the tray moving first reference frequency. These two types of reference frequencies become the reference for changing the tray moving reference sheet value and the tray moving first reference copy value in accordance with the level of the job frequency.

The tray moving reference sheet value memory unit 109 stores three types of sheet values as a tray moving reference sheet value, including a first sheet value, a second sheet value lower than the first sheet value and a third sheet value lower than the second sheet value. The first sheet value corresponds to the case when the job frequency is lower than the tray moving first reference frequency, the second sheet value corresponds to the case when the job frequency is equal to or higher than the tray moving first reference frequency but lower than the tray moving second reference frequency, and the third sheet value corresponds to the case when the job frequency is equal to or higher than the tray moving second reference frequency. Also, the tray moving reference copy value memory unit 110 stores three types of copy values as a tray moving first reference copy value, which are a first copy value, a second copy value lower than the first copy value and a third copy value lower than the second copy value. The first copy value corresponds to the case when the job frequency is lower than the tray moving first reference frequency, the second copy value corresponds to the case when the job frequency is equal to or higher than the tray moving first reference frequency but lower than the tray moving second reference frequency, and the third copy count value corresponds to the case when the job frequency is equal to or higher than the tray moving second reference frequency.

Figure 7:
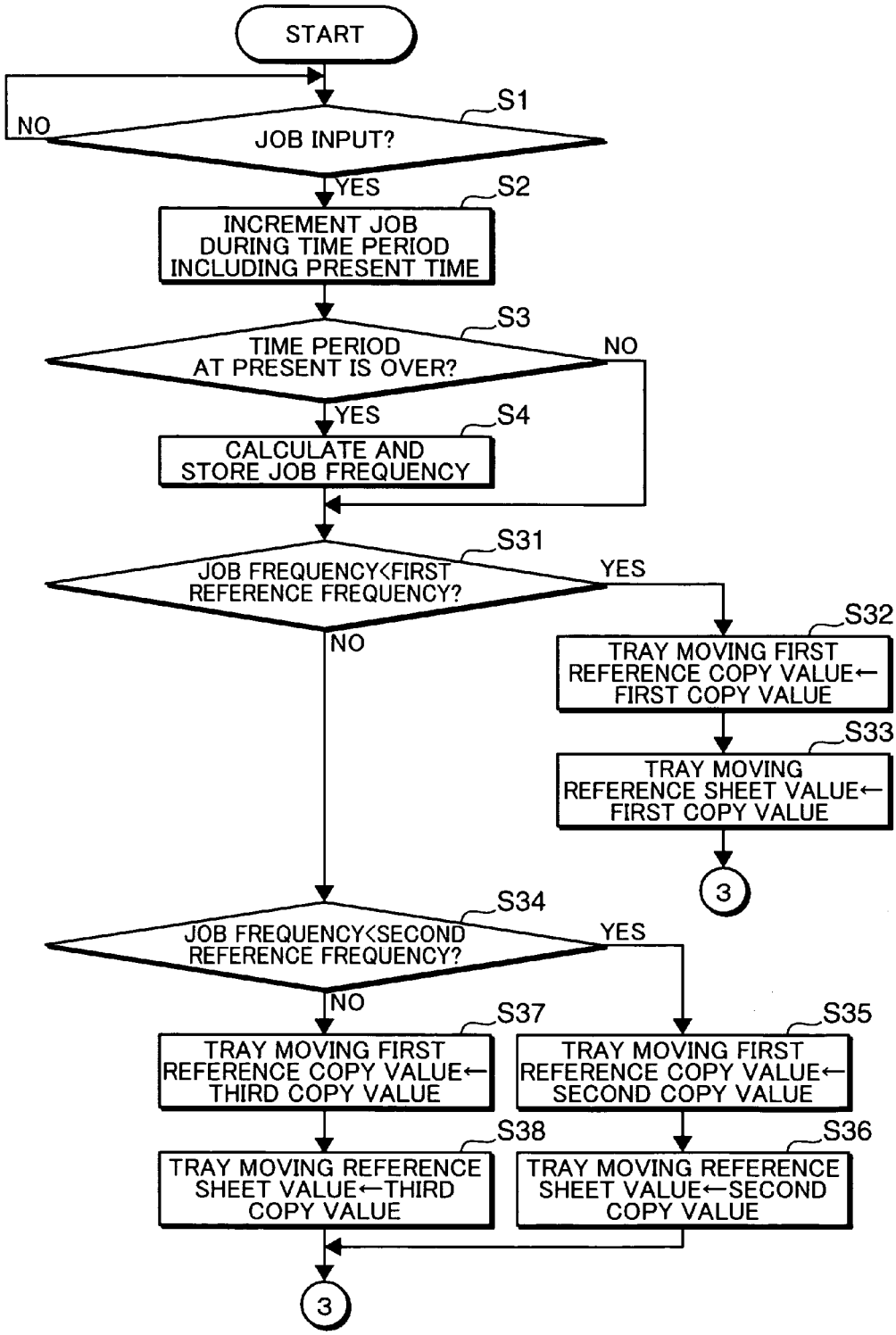
FIG. 7 is a part of a flow chart showing a tray moving control operation for the copy job executed by the composite machine according to a second embodiment of the invention.
Figure 8:
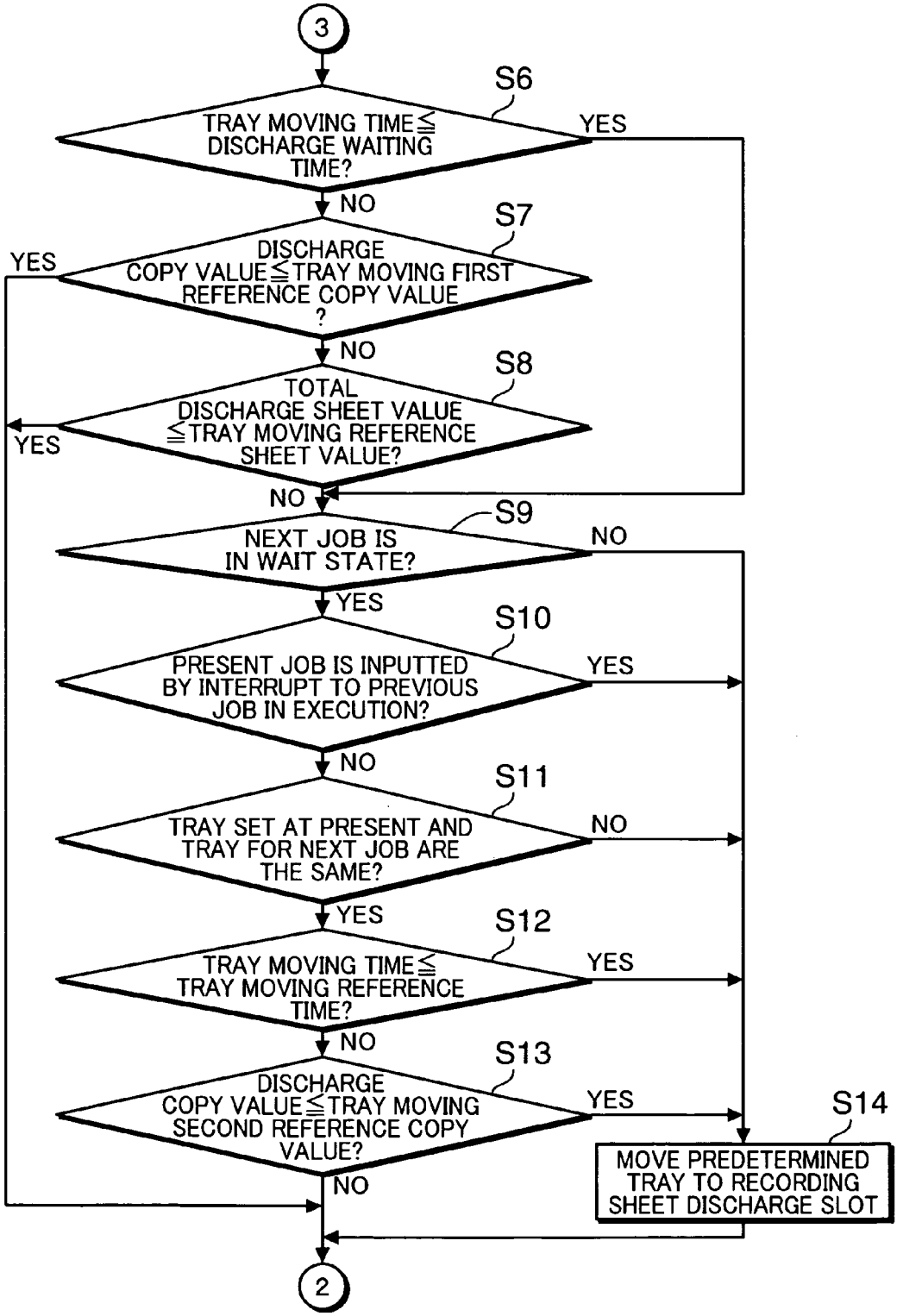
FIG. 8 is another part of the flow chart for the modified tray moving control operation.

FIG. 7, FIG. 8 and FIG. 6 (FIG. 6 also being referred to in the description of the first embodiment) are partial flowcharts describing the tray moving control operation according to the second embodiment in case a copy job is executed in the composite machine 1. Steps designated by the same number as in the first embodiment denote the operations described with respect to the first embodiment. In the following, a description is given only of the operations which are different from those described the first embodiment. Steps from Step S31 to S39 include operations for setting up the tray moving first reference copy value and the tray moving reference sheet value according to the job frequency during a time period when the job has been inputted.

In Step 31, the tray moving controller 106 checks the time period definition memory unit 112 and the date counter unit 113 to obtain a time period definition including the present time and then reads the job frequency during that time period from the job frequency memory unit 116. Also, the tray moving controller 106 receives the tray moving first reference frequency from the tray moving reference frequency memory unit 117 and compares this reference frequency with the job frequency. If the job frequency is lower than the tray moving first reference frequency (YES in Step S31), the flow continues to Step S32. In Step S32, the tray moving controller 106 decides to use the first copy value stored in the tray moving reference copy value memory unit 110 as the tray moving first reference copy value with respect to the job. In Step S33, the tray moving controller 106 decides to use the first sheet value stored in the tray moving reference sheet value memory unit 109 as the tray moving first reference sheet value for the job. In the branch of Step S31, if the job frequency is equal to or higher than the tray moving first reference frequency (NO in Step S31), the flow continues to Step S34.

In Step S34, the tray moving controller 106 receives the tray moving second reference frequency from the tray moving reference frequency memory unit 117 and then compares this reference frequency with the job frequency. If the job frequency is lower than the tray moving second reference frequency (YES in Step S34), the operation of Step S35 is initiated. In Step S35, the tray moving controller 106 decides to use the second copy value stored in the tray moving reference copy value memory unit 110 as the tray moving first reference copy value for the job. In Step S36, the tray moving controller 106 decides to use the second sheet value stored in the tray moving reference sheet value memory unit 109 as the tray moving reference sheet value for the job. In the branch of Step S34, if the job frequency is equal to or higher than the tray moving second reference frequency (NO in Step S34), the flow continues to Step S37.

In Step S37, the tray moving controller 106 decides to use the third copy value stored in the tray moving reference copy value memory unit 110 as the tray moving first reference copy value for the job. In Step S38, the tray moving controller 106 decides to use the third sheet value stored in the tray moving reference sheet value memory unit 109 as the tray moving reference sheet value for the job. When the operations of Step S33, Step S36 and Step S38 are completed, the flow continues to Step S6.

According to this embodiment, the recording sheets in a composite machine 1 are generally discharged to a tray already positioned at the recording sheet discharge slot at the time the job starts if the copy value of the recording sheets to be discharged in the job is equal to or lower than a copy value set in advance (tray moving first reference copy value), or to a desired tray if the copy value is higher than a copy value set in advance. However, if the total sheet value of the recording sheet to be discharged in the job is equal to or lower than a sheet value set in advance (tray moving reference sheet value), the recording sheets are discharged onto the tray already positioned at the recording sheet discharge slot at the time the job starts. Still, if the desired tray can be moved to the recording sheet discharge slot until the recording sheet discharge operation starts, irrespective of the above, the recording sheets are discharged to the desired tray. However, irrespective of all the above described, if the tray designated for to receive the recording sheets with respect to a job which is in a wait state following the job is the same as the tray already positioned at the recording sheet discharge slot at the time the job starts, all the recording sheets are discharged onto this tray. Even in such a case, if the tray moving time with respect to the job is within a predetermined time period (tray moving reference time) and the total discharge copy value of the recording sheets for the job is equal to or higher than a second copy value set in advance (tray moving second reference copy value), the recording sheets are discharged to a desired tray. Also, if a plurality of copies made of the same original document are to be discharged, the tray is moved in case there is sufficient time to carry out such operation between respective discharges of the copies. If the job frequency during the time period when the current job has been inputted is even higher, even smaller values are set as the tray moving first reference copy value and the tray moving reference sheet value. If the job frequency is even higher, the recording sheets for even more jobs are discharged to a desired tray and the trays are not moved only with respect to the jobs having an even smaller copy value or/and sheet value.

This invention is not limited to the above-described embodiments, but can also be considered in terms of the following aspects. In the above embodiments, description is given of an exemplary composite machine having a copier function and a printer function, more particularly of a case when a copy job is executed, however, the job to be executed does not necessarily have to be a copy job, but it may also be a print job. Also, if a facsimile function is added to the composite machine or if a facsimile function replaces the printer function, operation of the composite machine can be carried out substantially as described in these embodiments. More precisely, the facsimile function may be handled in a way similar to the printer function. In the embodiments, the recording sheets are discharged onto the non-sorting tray when the copier function is used and onto the sorting trays when the printer function is used. Nevertheless, in case of the printer function, the recording sheets may be discharged onto the non-sorting tray unless the discharge tray is particularly designated, and in case of the copier function, onto the sorting trays unless otherwise designated.

In the embodiments, the invention is applied with respect to the tray moving operation with respect to the copy job, but the tray moving operation can also be considered with respect to other jobs such as a print job, a facsimile job, etc.

In the embodiments, if the tray designated for a job which is in a wait state following a copy job to be started from now on is the same as the tray already positioned at the recording sheet discharge slot at the time the copy job starts, the recording sheets for the copy job to be started from now on is discharged onto this tray. Even in such a case, if the tray moving time with respect to the copy job is within a predetermined time (tray moving reference time) and the total discharge copy value of the recording sheets for the copy job is equal to or higher than a second copy value (tray moving second reference copy value) set in advance, the recording sheets are discharged to the non-sorting tray. However, if the tray for the copy job is determined taking into consideration the tray to receive the recording sheets for the wait-state job, such tray does not necessarily have to be determined by using the above-described method only. For instance, if routine reveals that the recording sheets are discharged with a high frequency to a particular tray in a wait-state job, that particular tray may be set to receive the recording sheets.

In the embodiments, the trays are moved if there is sufficient time for such an operation between respective discharges of the copies, however, such operation may also be carried out between respective discharges of the sheets of the recording sheets. Also, in the embodiments, the tray moving controller 106 checks whether there is sufficient time to completely move the tray to a target position between respective discharges of the copies and if there is, the tray is completely moved. The tray moving controller 106 also checks whether there is sufficient time to move the tray only one level between respective discharges of the copies, and if there is, the tray is moved only one level (or at least one level) at a time. Consequently, the tray is moved only one level during each interval between copy discharges until it reaches the target position. Also, the tray moving controller 106 may move the tray a movable amount (avoiding stop of the trays at a position not allowing discharge of the recording sheets) between respective discharges of the sheets or copies such that the trays are moved a little during each interval between respective copy discharges until the trays are completely moved to target position.

Figure 9:
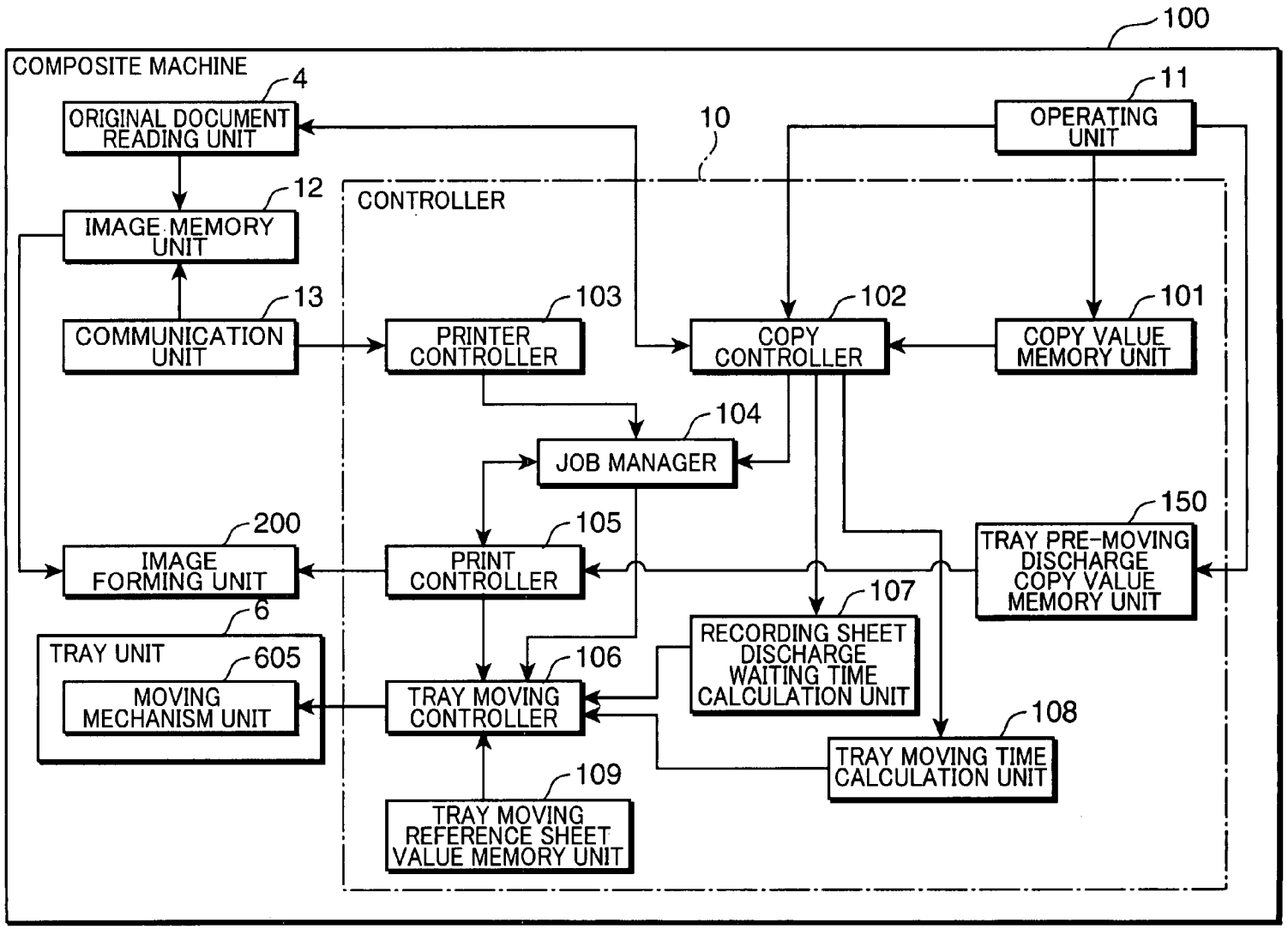
FIG. 9 is a block diagram showing a functional configuration of a composite machine according to a third embodiment of the invention.

Next, a composite machine 100 according to a third embodiment of the invention is described. The composite machine 100 has the configuration described with reference to FIG. 1. FIG. 9 is a block diagram showing a functional configuration of the composite machine 100 according to the third embodiment. Elements of the configuration which are the same as the composite machine 1 according to the first embodiment and described with reference to FIG. 2 and FIG. 3 are designated by the same symbols and further description thereof is hereby omitted.

The controller 10 of the composite machine 100 comprises a copy value memory unit 101, a tray pre-moving discharge copy value memory unit 150, a printer controller 103, a copy controller 102, a job manager 104, a print controller 105, a tray moving controller 106, a recording sheet discharge waiting time calculation unit 107, a tray moving time calculation unit 108 and a tray moving reference sheet value memory unit 109.

The tray pre-moving discharge copy value memory unit 150 stores the tray pre-moving discharge copy value inputted to the operating unit 11 by the operator. When the tray pre-moving discharge copy value is inputted to the operating unit 11, the tray pre-moving discharge copy value is written to the tray pre-moving discharge copy value memory unit 150.

The print controller 105 carries out a print control operation similar to that in the composite machine 1 according to the first embodiment. However, in case of a plurality of print jobs being executed at present, the print controller 105 of the composite machine 100 reads the tray pre-moving discharge copy value from the tray pre-moving discharge copy value memory unit 150 and if a number of copies of recording sheets equal to a tray pre-moving discharge copy value are printed with respect to one image forming job, it sends an instruction to the tray moving controller 106 to cause the moving mechanism unit 605 to move the tray.

The tray moving controller 106 carries out the tray moving control operation according to the received instruction similarly to that of the composite machine 1 of the first embodiment, however, with respect to a copy job, the tray moving controller 106 of the composite machine 100 causes a moving mechanism unit 605 to move the non-sorting tray to the recording sheet discharge slot if the recording sheets having the tray pre-moving discharge copy value are discharged without moving the tray until the recording sheets having the tray pre-moving discharge copy value are discharged. However, irrespective of this, the tray moving controller 106 carries out the following control operations: (1) it keeps the moving mechanism unit 605 from moving the tray until all the recording sheets for the copy job are discharged, if the total discharge sheet value of the recording sheets for the copy job is equal to or lower than a tray moving reference sheet value; or (2) it controls the moving mechanism unit 605 to move the non-sorting tray if the tray moving operation is completed until discharge of the recording sheets is initiated; or (3)) it keeps the moving mechanism unit 605 from moving the tray if the discharge tray for a job following a copy job inputted without interrupting the print job in execution and the tray positioned at the recording sheet discharge slot before the copy job starts are the same.

In order to execute a tray moving operation with respect to a copy job, the tray moving controller 106 determines whether to move the non-sorting tray to the recording sheet discharge slot according to the instruction regarding positioning of the non-sorting tray sent from the print controller 105, the recording sheet discharge waiting time calculated by the recording sheet discharge waiting time calculation unit 107, the tray moving time calculated by the tray moving time calculation unit 108, and the tray moving reference sheet value stored in the tray moving reference sheet value memory unit 109. This control operation is described in more detail with reference to the flow chart shown in FIG. 10.

Figure 10:
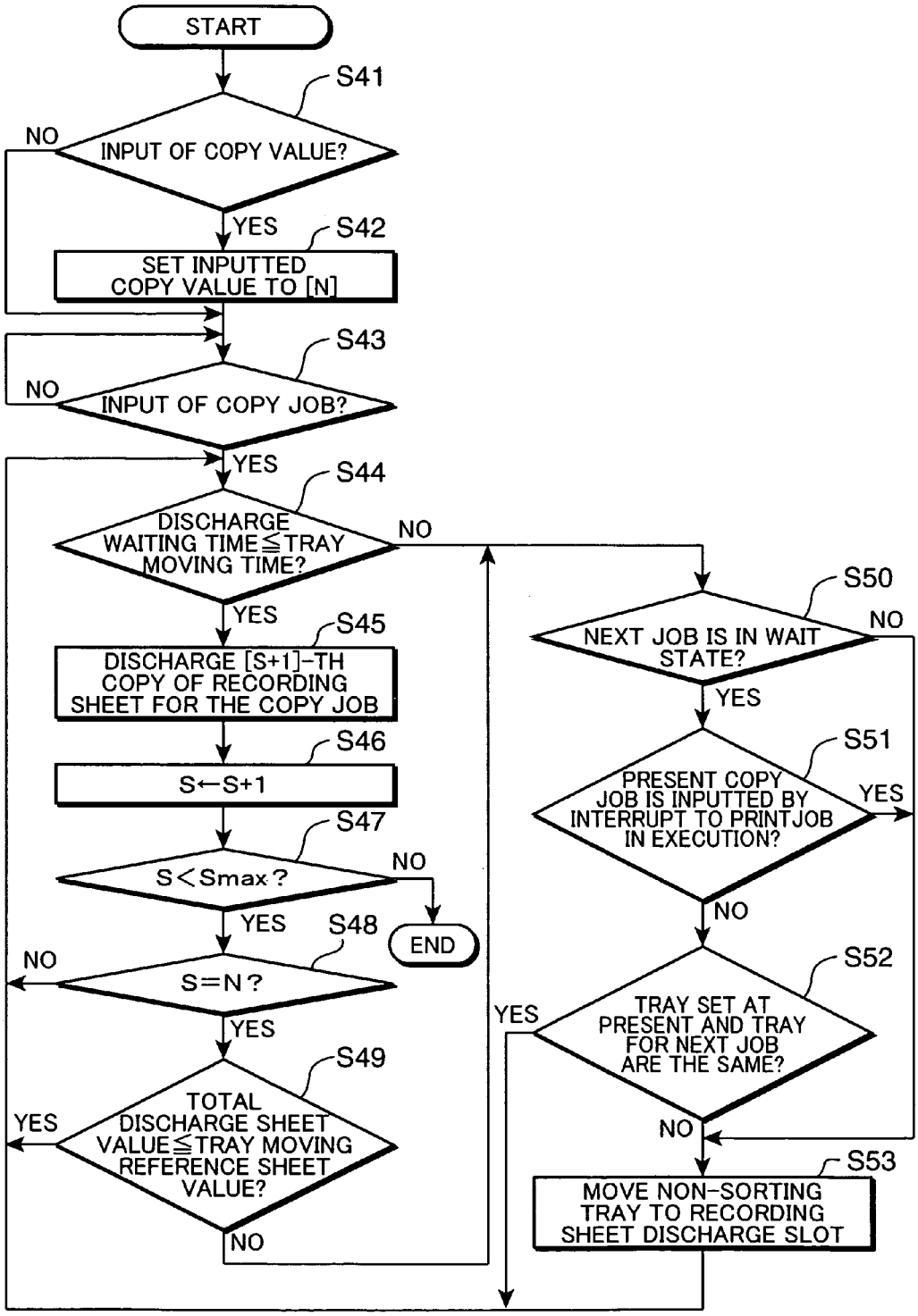
FIG. 10 is a flow chart showing a tray moving control operation during a copy job executed by the composite machine shown in FIG. 9.

FIG. 10 is a flow chart showing a flow of a tray moving control operation with respect to a copy job executed by the composite machine 100 of the third embodiment. A default value [1] is set as the tray pre-moving discharge copy value [N] and a default value [0] in set as the discharged copy value [S] 561 shown in FIG. 3. In Step 41, the operating unit 11 checks whether a tray pre-moving discharge copy value has been inputted thereto, and in case it has (YES in Step S41), the flow continues to Step S42. In Step S42, the operating unit 11 writes the inputted tray pre-moving discharge copy value to the tray pre-moving discharge copy value [N] of the tray pre-moving discharge copy value memory unit 150. In Step S41, if the tray pre-moving discharge copy value has not been inputted (NO in Step S41) and the operation of the Step S42 has been completed, then the flow continues to Step S43.

In Step S43, the operating unit 11 checks whether the start key thereof has been pressed or not (NO in Step S43), and if the start key is pressed (a command is inputted) (YES in Step S43), it informs the copy controller 102 that a copy job has been inputted by an operator. At this time, if a copy value is inputted to the operating unit with respect to the copy job, the copy value is written to the copy value [Smax] of the copy value memory unit 101. At the same time, the copy controller 102 sends an instruction to the original document reading unit 4 to read the image of the original document to be copied. The original document reading unit 4 reads the image of the original document according to the received instruction and then writes the read image data of the image to the image memory unit 12. The original document reading unit 4 also sends the address of the image data it has written to the image memory unit 12 and the number of pages of the image to the copy controller 102. Next, the copy controller 102 sends the data of the copy job (job data) to the job manager 104 which adds this copy job at the head (first line) of the job management table.

In Step S44, the copy controller 102 sends an instruction to the recording sheet discharge waiting time calculation unit 107 to calculate the time required until discharge of the recording sheets starts with respect to the copy job. The recording sheet discharge waiting time calculation unit 107 calculates the time till the start of the recording sheet discharge operation in accordance with the received instruction and sends the result to the tray moving controller 106. The copy controller 102 also sends an instruction to the tray moving time calculation unit 108 to calculate the time required to move the non-sorting tray 623 to the recording sheet discharge slot. The tray moving time calculation unit 108 calculates the tray moving time in accordance with the received instruction and then sends the result to the tray moving controller 106. The tray moving controller 106 compares the received time values and if the recording sheet discharge waiting time is equal to or lower than the tray moving time (YES in Step S44), the flow continues to Step S45.

In Step S45, the print controller 105 receives the job data (here, the copy job) of the job inputted in the head line of the job management table provided in the job manager 104 and sends to the image forming unit 200 an instruction to form images with respect to the copy [S+1] of recording sheets following the already discharged copy [S]. The image forming unit 200 forms an image (images) of the data image stored in the image memory unit on the recording sheets corresponding to a [S+1]-th copy according to the received instruction, after which the recording sheets bearing the image are discharged from the recording sheet discharge slot. In Step S46, the print controller 105 sends information to the job manager 104 each time a sheet is printed and the job manager 104 updates the outputted information 56 according to the received information. Here, one copy has been outputted, such that the discharged copy value [S] is updated to [S+1]. In Step S47, the print controller 105 finishes the processing if the discharged copy value [S] reaches the output copy value 54 [Smax] (NO in Step S47).

In Step S47, if the discharged copy value [S] does not reach the copy value [Smax] (YES in Step S47), the flow continues to Step S48. In Step S48, the print controller 105 reads the tray pre-moving discharge copy value [N] from the tray pre-moving discharge copy value memory unit 150 and the discharged copy value 561 [S] from the job manager 104 after which it compares these two values. If the discharged copy value [S] and the tray pre-moving discharge copy value [N] are the same (YES in Step S48), the print controller 105 sends an instruction to the tray moving controller 106 to control the moving mechanism unit 605 to move the non-sorting tray the recording sheet discharge slot. In Step S49, the tray moving controller 106 acquires the total discharge sheets 55 from the job manager 104 and at the same time reads the tray moving reference sheet value from the tray moving reference sheet value memory unit 109, after which it compares these two values. In Step S49, if the total discharge sheets is higher than the tray moving reference sheet value (NO in Step S49), and if in the branch of Step S44 the discharge waiting time is longer than the tray moving time (NO in Step S44), the flow continues to Step S50.

In Step S50, the tray moving controller 106 checks the job manager 104 to determine whether the next job is in a wait state (whether there are two or more lines in the job management table), and if it is in a wait state (YES in Step S50), the flow continues to Step S51. In Step S51, the tray moving controller 106 checks the job manager 104 to determine whether the copy job has been inputted by an interrupt to the print job in execution (whether the copy value 561 or sheet value 562 of the outputted information 56 with respect to the job in the second line of the job management table is [0]), and if it determines it has not been inputted by an interrupt (NO in Step S51), the flow continues to Step S52. In Step S52, the tray moving controller 106 receives the discharge tray number for the next job (the discharge tray number 57 from the second line of the job management table) from the job manager 104 and checks whether this discharge tray number is the same as the number of the discharge tray positioned at the recording sheet discharge slot at present. In Step S52, if the tray set at present and the tray for the next job are not the same (NO in Step S52), the next job is not in a wait state (NO in Step S50) in the branch of Step S50 and the copy job has been inputted by an interrupt to the print job in execution (YES in Step S51) in the branch of Step S51, the flow continues to Step S53. If the processing of Step S53 is completed, the tray set at present in the branch of Step S52 and the tray for the next job are the same (YES in Step S52), the discharged copy value 561[S] and the tray pre-moving discharge copy value [N] in the branch of Step S48 are not the same (NO in Step S48), and the total discharge sheet value is equal to or lower than the tray moving reference sheet in the branch of Step S49 (YES in Step S49), the flow continues to Step S45.

According to this embodiment, when using the copier function in the composite machine 100, the recording sheets are discharged to the tray already positioned at the recording sheet discharge slot at the time the copy job starts until a predetermined number of copies of the recording sheets are discharged and to the non-sorting tray after the predetermined number of copies of the recording sheets have been discharged. With this, the time interval when the tray is moved can be advantageously utilized for operations requiring the use of the recording sheets discharged beforehand (i.e. confirmation of formed image).

If the total sheet value of the recording sheets to be discharged in the copy job is equal to or lower than a predetermined sheet value, all the recording sheets are discharged to the tray already positioned at the recording sheet discharge slot at the time the copy job starts. Also, the tray is not moved in case of a relatively small discharge sheet value equal to or lower than a predetermined sheet value even if recording sheets having a copy value equal to or higher than the predetermined copy value are discharged, a situation can be avoided whereby the ratio of the tray moving time to the overall discharge time of the recording sheets is too long, thereby providing the user with a higher degree of convenience.

Also, if the non-sorting tray can be moved to the recording sheet discharge slot until the recording sheet discharge is initiated, irrespective of the above, all the recording sheets are discharged to the non-sorting tray, but if there is sufficient time to move a desired tray to the recording sheet discharge slot, the recording sheets are discharged to the desired tray.

Also, irrespective of all the above said, if the recording sheet discharge tray designated for to receive the recording sheets with respect to a job in a wait state following the copy job is the same as the tray already positioned at the recording sheet discharge slot at the time the copy job starts, then all the recording sheets are discharged to this tray. With this, the time interval when the tray is moved can be advantageously utilized for operations requiring the use of the recording sheets discharged beforehand (i.e. confirmation of formed image). At the same time, with this invention, it is possible to avoid situations whereby the tray moving time with respect to the overall discharge time, or the waiting time until all recording sheets are discharged becomes too long, thereby reducing unnecessary tray moving operations.

As described above, an inventive image forming apparatus comprises: an image former for forming an image on a recording sheet; a plurality of trays for receiving a recording sheet bearing an image formed thereon by the image former; a selector for selecting, among the plurality of trays, a tray for receiving the recording sheet bearing the image; a moving device for moving the selected tray to a recording sheet discharge position defined in an apparatus main body; a copy value taker for taking a copy value corresponding to the number of copies of recording sheets to be discharged in an image forming job before discharge of the recording sheet; and a controller for controlling the moving device to keep the selected tray from moving if the copy value is equal to or lower than the reference copy value.

In a case that one image forming job which interrupts an executing other image forming job to priorly execute the recording sheet discharge of the one image forming job over the other image forming job, the controller may preferably control the moving device to keep the selected tray from moving if the copy value is equal to or lower than the reference copy value.

The image forming apparatus may be preferably further provided with a sheet value calculator for calculating a sheet value corresponding to a total number of recording sheets to be discharged in the image forming job before discharge of the recording sheets. In this case, the controller may control the moving device to keep the trays from moving in the case that the sheet value calculated by the sheet value calculator is equal to or lower than a reference sheet value even if the copy value is higher than the reference copy value.

The image forming apparatus may be preferably further provided with a job frequency calculator for calculating the frequency of image forming jobs during a predetermined time period. In this case, the controller may set the reference copy value in accordance with the calculated job frequency.

Also, an inventive image forming apparatus comprising: an image former for forming an image on a recording sheet; a plurality of trays for receiving a recording sheet bearing an image formed thereon by the image former; a selector for selecting, among the plurality of trays, a tray for receiving the recording sheet bearing the image; a moving device for moving the selected tray to a recording sheet discharge position defined in an apparatus main body; a sheet value calculator for calculating a sheet value corresponding to a total number of recording sheets to be discharged in an image forming job before discharge of the recording sheet; and a controller for controlling the moving device to keep the selected tray from moving if the sheet value is equal to or lower than the reference sheet value.

The image forming apparatus may be preferably provided with a waiting time calculator for calculating a waiting time for waiting a start of recording sheet discharge; and a movement time calculator for calculating a movement time for moving the selected tray to the recording sheet discharge position. In this case, the controller may control the moving device to move the selected tray to the recording sheet discharge position in the case that the calculated movement time is shorter than the calculated waiting time even if the sheet value provided by the sheet value calculator is equal to or lower than the reference sheet value.

The image forming apparatus may be preferably provided with a tray determinator for determining, in a case that at least one waiting image forming job is set after a present image forming job in execution and a next image forming job following the present image forming job, which tray to receive a recording sheet to be discharged in the waiting image forming job. In this case, the controller may determine in accordance with a result of the tray determinator whether or not the tray movement for the next image forming job should be executed.

The controller may preferably control the moving device to move the selected tray to the recording sheet discharge position during an interval between recording sheet discharges in the case that the movement time is shorter than the recording sheet discharge interval even if the sheet value is equal to or lower than the reference sheet value and the sheet value calculated by the sheet value calculator is higher than the reference sheet value.

The image forming apparatus may be preferably provided with a job frequency calculator for calculating the frequency of image forming jobs during a predetermined time period. In this case, the controller may control the moving device to move the selected tray to the recording sheet discharge position in the case that the calculated job frequency is equal to or higher than a reference job frequency even if the sheet value is equal to or lower than the reference sheet value and the sheet value calculated by the sheet value calculator is higher than the reference sheet value.

The image forming apparatus may be preferably provided with a job frequency calculator for calculating the frequency of image forming jobs during a predetermined time period. In this case, the controller may set the reference sheet value in accordance with the calculated job frequency.

Further, an inventive image forming apparatus comprises: an image former for forming an image on a recording sheet; a plurality of trays for receiving a recording sheet bearing an image formed thereon by the image former; a selector for selecting, among the plurality of trays, a tray for receiving the recording sheet bearing the image; a moving device for moving the tray selected by the selector to a recording sheet discharge position defined in an apparatus main body; a copy counter for counting the number of copies of recording sheets discharged onto a tray in each image forming job; and a controller for controlling the moving device to keep the tray from moving until at least one copy of discharged recording sheets is counted by the copy counter.

In a case that one image forming job which interrupts an executing other image forming job to priorly execute the recording sheet discharge of the one image forming job over the other image forming job, the controller may preferably control the moving device to keep the tray from moving until at least one copy of discharged recording sheets is counted by the copy counter.

The image forming apparatus may be preferably provided with an input device for allowing an operator to input a number of copies. In this case, the controller may control the moving device to keep the tray from moving until the input number of copies of discharged recording sheets is counted by the copy counter.

The image forming apparatus may be preferably provided with a sheet value calculator for calculating a total sheet value of recording sheets to be discharged in an image forming job before starting the recording sheet discharge. In this case, the controller may control the moving device to keep the tray from moving in the case that the total sheet value is equal to or lower than a reference sheet value even after at least one copy of discharged recording sheets is counted by the copy counter.

The image forming apparatus may be further provided with a waiting time calculator for calculating a waiting time for waiting a start of recording sheet discharge, and a movement time calculator for calculating a movement time for moving the selected tray to the recording sheet discharge position. In this case, the controller may control the moving device to move the selected tray to the recording sheet discharge position in the case that the calculated waiting time is longer than the calculated movement time even until at least one copy of discharged recording sheets is counted by the copy counter.

The image forming apparatus may be further provided with a determinator for determining, in a case that at least one waiting image forming job is set after a present image forming job in execution and a next image forming job following the present image forming job, whether a tray for receiving a recording sheet to be discharged in the present image forming job is the same as a tray for receiving a recording sheet to be discharged in the waiting image forming job. In this case, the controller may control the moving device to keep the tray from moving without connection with a try for the next image forming job in the case that the determinator determines that the trays are the same.

With these constructions, if the copy value corresponding to the number of copies of recording sheets to be discharged which is taken by the copy value taker is equal to or lower than the predetermined copy value, the controller controls the moving device to keep the selected tray from moving. Consequently, the selected tray is not moved and the recording sheet is discharged onto a tray placed at the recording sheet discharge position at the time the recording sheet is discharged. In a conventional image forming apparatus, in case of making only one copy or a relatively small number of copies of a document, the image forming operation and the recording sheet discharge operation can be completed in a short time. In such a case, an operation of moving a desired tray to the recording sheet discharge position requires a longer time such that the total amount of time from start of image forming operation to discharge of the recording sheets becomes long. With this invention, if a copy value corresponding to the number of copies of recording sheets to be discharged is set to a relatively small copy value such as 1 copy, the recording sheets are discharged to the tray placed at the recording sheet discharge position at the time of recording sheet discharge without moving the intended tray, thereby avoiding waste of time required for moving the intended tray and enabling completion of the image forming and recording sheet discharge operation in less time than in the conventional apparatuses. Specifically, the invention enables improvement of movement of the discharge trays by avoiding a situation where the tray movement time is too long as compared to the overall time needed from when the image forming operation starts until discharge of the recording sheets, thereby providing the user with a higher degree of convenience.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. An image forming apparatus comprising:

an image former for forming an image on a recording sheet;

a plurality of trays for receiving a recording sheet bearing an image formed thereon by the image former;

a selector for selecting, among the plurality of trays, a tray for receiving the recording sheet bearing the image;

a moving device for moving the selected tray to a recording sheet discharge position defined in an apparatus main body;

a copy value taker for taking a copy value corresponding to the number of copies of recording sheets to be discharged in an image forming job before discharge of the recording sheet; and a controller for controlling the moving device to keep the selected tray from moving if the copy value is equal to or lower than a reference copy value.

2. The image forming apparatus according to claim 1, wherein in one image forming job which interrupts an executing other image forming job to priorly execute the recording sheet discharge of the one image forming job over the other image forming job, the controller controls the moving device to keep the selected tray from moving if the copy value is equal to or lower than the reference copy value.

3. The image forming apparatus according to claim 1, further comprising:

a sheet value calculator for calculating a sheet value corresponding to a total number of recording sheets to be discharged in the image forming job before discharge of the recording sheets, wherein the controller controls the moving device to keep the trays from moving in the case that the sheet value calculated by the sheet value calculator is equal to or lower than a reference sheet value even if the copy value is higher than the reference copy value.

4. The image forming apparatus according to claim 3, further comprising a job frequency calculator for calculating the frequency of image forming jobs during a predetermined time period, wherein the controller sets the reference copy value in accordance with the calculated job frequency.

5. The image forming apparatus according to claim 3, further comprising a job frequency calculator for calculating the frequency of image forming jobs during a predetermined time period, wherein the controller sets the reference sheet value in accordance with the calculated job frequency.

6. The image forming apparatus according to claim 1, further comprising a job frequency calculator for calculating the frequency of image forming jobs during a predetermined time period, wherein the controller sets the reference copy value in accordance with the calculated job frequency.

7. The image forming apparatus according to claim 1, further comprising:

a waiting time calculator for calculating a waiting time for waiting a start of recording sheet discharge; and a movement time calculator for calculating a movement time for moving the selected tray to the recording sheet discharge position;

wherein the controller controls the moving device to move the selected tray to the recording sheet discharge position in the case that the calculated movement time is shorter than the calculated waiting time even if the copy value provided by the copy value taker is equal to or lower than the reference copy value.

8. The image forming apparatus according to claim 1, further comprising:

a job frequency calculator for calculating the frequency of image forming jobs during a predetermined time period, wherein the controller controls the moving device to move the selected tray to the recording sheet discharge position in the case that the calculated job frequency is equal to or higher than a reference job frequency even if the copy value is equal to or lower than the reference copy value.

9. An image forming apparatus comprising:

an image former for forming an image on a recording sheet;

a plurality of trays for receiving a recording sheet bearing an image formed thereon by the image former;

a selector for selecting, among the plurality of trays, a tray for receiving the recording sheet bearing the image;

a moving device for moving the selected tray to a recording sheet discharge position defined in an apparatus main body;

a sheet value calculator for calculating a sheet value corresponding to a total number of recording sheets to be discharged in an image forming job before discharge of the recording sheet; and a controller for controlling the moving device to keep the selected tray from moving if the sheet value is equal to or lower than a reference sheet value.

10. The image forming apparatus according to claim 9, further comprising:

a waiting time calculator for calculating a waiting time for waiting a start of recording sheet discharge; and a movement time calculator for calculating a movement time for moving the selected tray to the recording sheet discharge position;

wherein the controller controls the moving device to move the selected tray to the recording sheet discharge position in the case that the calculated movement time is shorter than the calculated waiting time even if the sheet value provided by the sheet value calculator is equal to or lower than the reference sheet value.

11. The image forming apparatus according to claim 9, further comprising:

a tray determinator for determining, in a case that at least one waiting image forming job is set after a present image forming job in execution and a next image forming job following the present image forming job, which tray to receive a recording sheet to be discharged in the waiting image forming job;

wherein the controller determines in accordance with a result of the tray determinator whether or not the tray movement for the next image forming job should be executed.

12. The image forming apparatus according to claim 10, wherein the controller controls the moving device to move the selected tray to the recording sheet discharge position during an interval between recording sheet discharges in the case that the movement time is shorter than the recording sheet discharge interval even if the sheet value is equal to or lower than the reference sheet value and the sheet value calculated by the sheet value calculator is higher than the reference sheet value.

13. The image forming apparatus according to claim 9, further comprising:

a job frequency calculator for calculating the frequency of image forming jobs during a predetermined time period, wherein the controller controls the moving device to move the selected tray to the recording sheet discharge position in the case that the calculated job frequency is equal to or higher than a reference job frequency even if the sheet value is equal to or lower than the reference sheet value and the sheet value calculated by the sheet value calculator is higher than the reference sheet value.

14. The image forming apparatus according to claim 9, further comprising a job frequency calculator for calculating the frequency of image forming jobs during a predetermined time period, wherein the controller sets the reference sheet value in accordance with the calculated job frequency.

15. An image forming apparatus comprising:

an image former for forming an image on a recording sheet;

a plurality of trays for receiving a recording sheet bearing an image formed thereon by the image former;

a selector for selecting, among the plurality of trays, a tray for receiving the recording sheet bearing the image;

a moving device for moving the tray selected by the selector to a recording sheet discharge position defined in an apparatus main body;

a copy counter for counting the number of copies of recording sheets discharged onto a tray in each image forming job; and a controller for controlling the moving device to keep the tray from moving until at least one copy of discharged recording sheets is counted by the copy counter.

16. The image forming apparatus according to claim 15, wherein, in one image forming job which interrupts an executing other image forming job to priorly execute the recording sheet discharge of the one image forming job over the other image forming job, the controller controls the moving device to keep the tray from moving until at least one copy of discharged recording sheets is counted by the copy counter.

17. The image forming apparatus according to claim 15, further comprising:

an input device for allowing an operator to input a number of copies, wherein the controller controls the moving device to keep the tray from moving until the input number of copies of discharged recording sheets is counted by the copy counter.

18. The image forming apparatus according to claim 15, further comprising:

a sheet value calculator for calculating a total sheet value of recording sheets to be discharged in an image forming job before starting the recording sheet discharge, wherein the controller controls the moving device to keep the tray from moving in the case that the total sheet value is equal to or lower than a reference sheet value even after at least one copy of discharged recording sheets is counted by the copy counter.

19. The image forming apparatus according to claim 15, further comprising:

a waiting time calculator for calculating a waiting time for waiting a start of recording sheet discharge, and a movement time calculator for calculating a movement time for moving the selected tray to the recording sheet discharge position, wherein the controller controls the moving device to move the selected tray to the recording sheet discharge position in the case that the calculated waiting time is longer than the calculated movement time even until at least one copy of discharged recording sheets is counted by the copy counter.

20. The image forming apparatus according to claim 15, further comprising:

a determinator for determining, in a case that at least one waiting image forming job is set after a present image forming job in execution and a next image forming job following the present image forming job, whether a tray for receiving a recording sheet to be discharged in the present image forming job is the same as a tray for receiving a recording sheet to be discharged in the waiting image forming job, wherein the controller controls the moving device to keep the tray from moving without connection with a try for the next image forming job in the case that the determinator determines that the trays are the same.

* * * * *